US010996015B2

(12) United States Patent
Lee

(10) Patent No.: US 10,996,015 B2
(45) Date of Patent: May 4, 2021

(54) FIREARM ADAPTER

(71) Applicant: DBDROP, Inc., Fort Myers, FL (US)

(72) Inventor: Darryl S. Lee, Fort Myers, FL (US)

(73) Assignee: NSSIP LLC, Fort Myers, FL (US)

( * ) Notice: Subject to any disclaimer, the term of this patent is extended or adjusted under 35 U.S.C. 154(b) by 43 days.

(21) Appl. No.: 16/253,998

(22) Filed: Jan. 22, 2019

(65) Prior Publication Data

US 2019/0154387 A1 May 23, 2019

Related U.S. Application Data

(63) Continuation-in-part of application No. 15/642,467, filed on Jul. 6, 2017, now Pat. No. 10,190,839, and a continuation-in-part of application No. 15/625,542, filed on Jun. 16, 2017, now Pat. No. 10,302,384, which is a continuation of application No. 15/601,528, filed on May 22, 2017, now Pat. No. 9,891,017, and a continuation of application No. 15/499,430, filed on Apr. 27, 2017, now Pat. No. 10,066,890, said application No. 15/642,467 is a continuation of application No. 15/499,430, filed on Apr. 27, 2017, now Pat. No. 10,066,890.

(51) Int. Cl.
*F41A 21/32* (2006.01)
*F41A 21/30* (2006.01)

(52) U.S. Cl.
CPC ..... *F41A 21/325* (2013.01); *F41A 21/30* (2013.01)

(58) Field of Classification Search
CPC ..... F41A 21/00; F41A 21/30; F41A 21/32; F41A 21/325; F41A 21/34; F41A 21/36; F41A 21/38; F41A 21/40; F41A 21/42; F41A 21/44
USPC ..... 42/76.01, 79, 1.06; 89/14.2–14.4; 181/223
See application file for complete search history.

(56) References Cited

U.S. PATENT DOCUMENTS 2,351,037 A * 6/1944 Green ..... F41A 21/34 89/14.5
2,453,747 A * 11/1948 Egleson ..... F41A 21/42 42/79
2,866,288 A 12/1958 Herter
2,989,815 A * 6/1961 Hare ..... F41A 21/42 42/79
3,710,679 A * 1/1973 Werbell, III ..... F41A 21/30 89/14.4
3,769,731 A * 11/1973 Pachmayr ..... F41A 21/40 42/79

(Continued)

*Primary Examiner* — Stephen Johnson
*Assistant Examiner* — Benjamin S Gomberg
(74) *Attorney, Agent, or Firm* — Nicholas Pfeifer; Smith & Hopen, P.A.

(57) ABSTRACT

A fast-attaching, self-aligning, easily adaptable firearm adapter. The novel adapter attaches to the barrel of a firearm while precisely aligning the barrel and adapter using a concentric constriction sleeve along the barrel and a barrel guide to funnel firearm muzzle. The device is adapted to attach to a wide range of barrel diameters via an easy to fit and inexpensive to manufacture fitment sleeve. Thus, the adapter can be manufactured in a single size and work with most firearms. In addition, the device attaches to the smooth section of barrel thereby eliminating the need for permanently modifying a firearm by threading the barrel.

17 Claims, 25 Drawing Sheets

(56) References Cited

U.S. PATENT DOCUMENTS 3,776,093 A * 12/1973 Leverance ..... F41A 21/30 89/14.4
3,797,155 A * 3/1974 Smith ..... F41A 21/42 42/79
4,510,843 A * 4/1985 Rabatin ..... F41A 21/325 89/14.4
4,663,875 A 5/1987 Tatro
4,939,977 A * 7/1990 Stroup ..... F41A 21/30 89/14.4
5,433,133 A * 7/1995 La France ..... F41A 21/325 89/14.2
5,753,846 A * 5/1998 Koon ..... F41A 21/28 42/75.02
5,794,374 A * 8/1998 Crandall ..... F41C 27/22 42/76.01
6,619,179 B2 * 9/2003 Mika ..... F41A 21/36 42/77
6,769,346 B2 8/2004 Rosenthal
6,973,863 B1 * 12/2005 Jones ..... F41A 21/26 89/14.2
7,677,150 B2 * 3/2010 Dater ..... F41A 21/325 89/14.05
8,186,261 B2 * 5/2012 McNeill ..... F41A 21/38 181/223
8,910,746 B1 * 12/2014 McKenzie ..... F41A 21/30 181/223
8,973,481 B2 * 3/2015 Dueck ..... F41A 21/325 181/223
9,631,888 B2 * 4/2017 Young ..... F41A 21/325
9,739,560 B1 * 8/2017 Salvador ..... F41A 21/00
10,082,355 B2 * 9/2018 Addis ..... F41A 21/325
10,234,229 B2 * 3/2019 Lessard ..... F41A 21/325
10,480,884 B2 * 11/2019 Smith ..... F41A 21/30
2003/0182838 A1 10/2003 Kessler
2009/0193963 A1 * 8/2009 Poulsen ..... F41A 21/30 89/14.2
2012/0167435 A1 7/2012 Poling
2015/0362276 A1 * 12/2015 Fischer ..... F41G 11/003 89/14.4
2016/0097609 A1 * 4/2016 Penchuk ..... F41A 21/325 42/76.01

* cited by examiner

FIREARM ADAPTER

CROSS-REFERENCE TO RELATED APPLICATIONS

This nonprovisional application is a continuation in part of and claims priority to nonprovisional application Ser. No. 15/642,467, now U.S. Pat. No. 10,190,839, entitled "FIREARM BARREL ALIGNMENT GUIDE," filed Jul. 6, 2017 by the same inventor, which is a continuation of and claims priority to nonprovisional application Ser. No. 15/499,430, now U.S. Pat. No. 10,066,890, entitled "FIREARM SUPPRESSOR ADAPTER," filed Apr. 27, 2017 by the same inventor.

This nonprovisional application is also a continuation in part of and claims priority to nonprovisional application Ser. No. 15/625,542, now U.S. Pat. No. 10,302,384, entitled "FIREARM BARREL FITMENT SLEEVE AND METHOD OF USE," filed Jun. 16, 2017 by the same inventor which is a continuation of and claims priority to nonprovisional application Ser. No. 15/499,430, now U.S. Pat. No. 10,066,890, entitled "FIREARM SUPPRESSOR ADAPTER," filed Apr. 27, 2017 by the same inventor, and is also a continuation of and claims priority to nonprovisional application Ser. No. 15/601,528, now U.S. Pat. No. 9,891,017, entitled "FIREARM SUPPRESSOR ADAPTER," filed May 22, 2017 by the same inventor.

BACKGROUND OF THE INVENTION

1. Field of the Invention

This invention relates, generally, to firearms adapters. More specifically, it relates to a universal adapter for muzzle devices such as firearm suppressors.

2. Brief Description of the Prior Art

Most gun shots produce sound that exceeds 140 dB, which can cause immediate and irreparable hearing loss to the gun operate and also significantly contributes to sound pollution. The effects of gun-fire noise are evidenced by the prevalence of hearing damage among veterans, law enforcement, and older individuals that have been around unsuppressed gunfire. Fortunately, there are muzzle devices referred to as "firearm suppressors" or "silencers" capable of reducing the gun-fire noise to a safe hearing range below 140 dB.

The primary functions of a suppressor are to trap, intercept, contain, disrupt, slow and/or redirect the expanding gas of the muzzle blast of a firearm. This allows the gas to slow and dissipate prior to exiting the muzzle of the suppressor. When gas is allowed or forced to slow and cool, the report of the gunshot is lowered to a non-damaging level. The longer the gas stays in the suppressor, the more the heat dissipates, and in turn, less sound in produced.

Up to now, in spite of the obvious health and societal benefits of suppressor use, a suppressor could not easily be fitted to most firearms without using inflexible, narrowly sized, mostly unavailable, and possibly damaging adapters; or without having the gun barrel cut and machined by a gunsmith on a lathe.

There are a few current methods for attaching a suppressor to a non-threaded barrel of a firearm. Among other problems, these methods can be time consuming, imprecise, and damaging to the gun. Most importantly, however, they are inflexible and only work with a very narrow range of firearms with a similar barrel diameter, barrel geometry, and location of barrel protrusions.

The most common method for attaching a suppressor to a non-threaded barrel firearm, is to hire a gunsmith to machine threads onto the barrel. Unfortunately, this process permanently alters the firearm. Many gun enthusiasts are unwilling to alter the factory dynamics of their firearm. It will never be original after this process, which can negatively affect the value of some guns. This process can also be costly and time consuming. For example, the process typically includes:

1. Finding a gunsmith that cuts barrel threads, which is often difficult because the gunsmith profession is a dying trade. There are also new government regulations requiring gunsmiths to register with ITAR and pay a $2,250 tax. The gunsmith profession is a low profit business for many and this new regulation, if not repealed, will cause some to drop out of the profession.
2. The next step includes a federally licensed dealer logging the gun into his/her acquisitions and dispositions book. There are many gun enthusiasts that become dissuaded from using gunsmiths because of this gun logging step.
3. Next, the gunsmith has to disassemble the gun and then use a lathe to precisely carve threads into the barrel at a specific size and tolerance. This is important because the threads can be cut in 7 or 8 different configuration. The gun is only able to mount a suppressor having the exact thread size and thread turn that corresponds to the threads cut into the barrel. In addition, a gunsmith only has one opportunity to correctly thread the barrel. The changes are permanent and cannot be fixed.
4. Finally, the gunsmith has to reassemble the gun and then the gunsmith or federally licensed dealer has to log the gun out of their acquisitions and dispositions book.
5. In addition, had the gun owner needed to send the barrel to an out of town gunsmith, the gun owner must perform the extra steps of disassembling the gun, finding the proper means for mailing the barrel, and reassembling the gun when the barrel is returned.

Alternatively, a suppressor can be secured to a gun using of one of the existing adapter systems listed below:

1. A set screw system manufactured to a certain diameter for a particular firearm. This system is intended to slide onto the end of the muzzle and tightened thereto using set screws. Unfortunately, these adapters require specific tools to tighten the set screws and said set screws can damage the barrel when tightened. Moreover, this system is not consistently centered to the muzzle due to the fluctuations in barrel size. This size difference in barrels can be found even within the same gun model from one year to the next. Furthermore, barrel diameter is measured in hundredths or thousandths of an inch. To manufacture and stock an adapter that can fit every barrel from 0.5 to 1 inch, even if only measuring to the hundredths, would take 50 different sizes. Finally, this method is not recommended for tapered barrels, which are prevalent in a majority of long guns. When you add other geometrical differences like tapered verses straight barrels, barrels with iron sights verses unobstructed barrels, and barrels with and without shrouds, there are thousands of different barrel types requiring thousands of versions of this adapter. The manufacturing cost, packaging cost and inventory cost is prohibitive, which is why the set screw-style adapter is typically only manufactured for a few barrels.
2. A bolt-on an adapter manufactured for an exact barrel size. This adapter style is manufactured for straight barrels or barrels with obstructions. This method is not recommended for tapered barrels. The adapters are usually manufactured for specific gun models due to the expense of machining and inventorying all of the different sizes required to fit other models. This adapter requires tools and time to install. When you consider other geometrical differences like barrels with iron sights and barrels with shrouds, it is clear that this style of an adapter is a custom adapter incapable of attaching to a variety of gun barrels.

3. A very limited suppressor adapter is designed to mount to a barrel nut on an AR platform gun. The barrel nut adapter fits one barrel and only one style of gun. Similar to the other options, this system requires tools and time to install.
4. Another option is attaching an adapter to the iron sights at the end of a barrel. This is not a recommended method to install anything on a gun, let alone, a suppressor that has a large amount of longitudinal force pulling against the sight when the gun is fired. The iron sight has to be a certain distance from the muzzle of the gun due to the specific groove length cut into the adapter for fitment to the iron sight. To install this adapter on a different gun, the iron sights would have to have the same measurement from the muzzle to the rear of sight and the same barrel diameter. Similar to the other methods, each version of this adapter is made for a particular gun and lacks the ability to fit different gun models.
5. Finally, there is a method of attaching the adapter to a groove or grooves in the flash hider of an AR style platform gun with a certain size and style flash hider at the end of the barrel. This adapter is only usable for one style of gun where the distance between the muzzle and the groove on the flash hider is the same. The lack of variability occurs because the engagement of the adapter fins into the flash hider groove is achieved at a set distance from the muzzle. The length between the muzzle and the grove is not adjustable and, therefore, this style adapter it is not adaptable to other guns.

All of these methods have drawbacks and problems that prevent the respective adapters from being widely adopted. Accordingly, what is needed is a firearm adapter that can overcome all of the problems listed above, providing an easy-to-use, adapter that can quickly, accurately, securely, and concentrically attach a muzzle device, such as a suppressor or suppressor extension to the barrel of a firearm. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicant in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an easy-to-use, adapter that can quickly, accurately, securely, and concentrically attach a muzzle device, such as suppressor or suppressor extension to the barrel of a variety of firearms is now met by a new, useful, and nonobvious invention.

In an embodiment, the novel structure includes a first sheath rotatably secured to a second sheath. A constricting sleeve at least partially resides within the first sheath and is integrated into or mechanically fixed to the second sheath in a non-rotational manner. A compression collar is disposed between the constricting sleeve and the first sheath or radially integrated with the first sheath.

The constricting sleeve has a first end, a second end, and a flexible body extending therebetween. In an embodiment, the constricting sleeve has tubular cross-section establishing an outer surface and an inner surface. The inner surface has a smaller diameter than the outer surface, and the outer surface has a tapered design along the longitudinal axis of the constricting sleeve. As such, the diameter of the outer surface proximate the first end is less than the diameter of the outer surface proximate the second end.

In an embodiment, the first end of the constricting sleeve has a plurality of flexible arms establishing a discontinuous circumference at the first end of the constricting sleeve, such that the plurality of flexible arms is capable of compressing towards the longitudinal axis to reduce the inner diameter of the constricting sleeve. An embodiment may also or independently include the second end having a plurality of slots establishing a discontinuous circumference at the second end of the constricting sleeve. The slots are designed to interconnect a force transferring collar having a plurality of fins extending in an axial direction. The force transferring collar is in mechanical communication with the second sheath. The interconnection of the plurality of fins and the plurality of slots thereby prevents rotation of the restricting sleeve with respect to the force transferring collar, and in turn, the second sheath.

In an embodiment, the compression collar is in threaded communication with the first sheath, but rotationally fixed with respect to the constricting sleeve. The compression collar includes a first end and a second end with a tubular cross-section establishing an outer surface and an inner surface. The inner surface has a smaller diameter than the outer surface, and the inner surface is a tapered along the extent of the collar. As a result, the diameter of the inner surface near the first end is less than the diameter of the inner surface near the second end.

The constricting sleeve and the compression collar are inversely oriented with respect to each other, such that the tapered outer surface of the constricting sleeve increases in diameter in a first direction and the tapered inner surface of the compression collar increases in diameter in the same direction. Therefore, movement of the compression collar in the first direction produces a downward force on the constricting sleeve as the second end of the compression collar, the end with a lesser inner diameter, moves towards the second end of the constricting sleeve, the end with a greater outer diameter.

An embodiment also includes a barrel guide concentrically aligned with the constricting sleeve. In an embodiment, the barrel guide is in structural communication with the second sheath. In any embodiment, the barrel guide includes an aperture concentrically aligned with the constricting sleeve, thereby providing a passage for a bullet leaving the barrel of the firearm. The barrel guide further includes curved or angled walls having a first end near the aperture and extending in an aft direction, such that a distance between the walls increases towards the aft direction. As a result, an axial force causing the barrel of the firearm to contact the barrel guide will funnel the barrel into axial alignment with the aperture.

An embodiment includes a flexible fitment sleeve having an incomplete tubular shape resulting in an adjustable diameter. The fitment sleeve is relied upon for effectively increasing the barrel diameter to allow a single adapter to work with any barrel diameter. The fitment sleeve may have a tapered design to account for tapered barrels. In addition, the fitment sleeve may incorporate the barrel guide.

An embodiment includes a suppressor attachment extending from the second sheath in an axial direction away from the first sheath and in concentric alignment with the aperture in the alignment guide. The suppressor attachment has external threads on which a suppressor can be secured. Alternatively, the second sheath may be axially integrated into a suppressor or suppressor extension.

An embodiment of the firearm adapter includes a sheath that receives at least a portion of the constricting sleeve. The sheath has a first end, a second end, and a tubular body extending therebetween and establishing an inner surface. The second end is integrated with a muzzle device or attachable to the muzzle device. The constricting sleeve has a first end, a second end, and a tubular body extending therebetween and establishing an inner surface. At least a portion of the first end has a discontinuous perimeter thereby enabling the inner surface to adjust in diameter. Moreover, the inner surface has a diameter that is greater than a diameter of a firearm barrel when the constricting sleeve receives the firearm barrel. Furthermore, at least one of an outer surface of the first end of the constricting sleeve and the inner surface of the first end of the sheath is tapered inwardly towards the second end of the sheath.

In an embodiment, the constricting sleeve further includes an inwardly extending catchment flange adapted to catch a proximal end of an anchor or a barrel device extending outwardly from the firearm barrel. An embodiment of the anchor is adapted to at least partially encircle and be secured to the firearm barrel and also has an outer diameter greater than the firearm barrel. An embodiment of the barrel device is a flash hider.

An embodiment of the adapter further includes the second end of the constricting sleeve having a plurality of threads adapted to engage a plurality of threads disposed on the sheath. An embodiment also includes a release mechanism adapted to engage the first end of the constricting sleeve, wherein manipulation of the release mechanism causes the second end of the constricting sleeve to increase in diameter. In an embodiment, the constricting sleeve further includes an outwardly extending catchment flange adapted to catch a portion of a firearm rail.

An embodiment of the adapter further includes a barrel guide in communication with the sheath or muzzle device. The barrel guide has a tapered aperture concentrically aligned with the constricting sleeve, thereby providing a passage for a bullet leaving the firearm barrel. The tapered aperture has a greater diameter at a proximal end than at a distal end and an axial force causing the firearm barrel to contact the tapered aperture of the barrel guide will funnel the firearm barrel into axial alignment with the aperture. An embodiment further includes a spring disposed between a spring platform on the barrel guide and a spring base on the sheath or muzzle device, with the spring forcing the barrel guide in a proximal direction.

An embodiment of the adapter further includes a gas containment sleeve that fits into or around a flash hider to direct expelled gases into the muzzle device. In an embodiment, the gas containment sleeve includes threads to engage a threaded portion of the sheath or muzzle device. In an embodiment, a spring is disposed between a spring platform on the gas containment sleeve and a spring base on the sheath or muzzle device with the spring forcing the gas containment sleeve in a proximal direction.

An object of the invention is to provide an adapter configured to fit most firearms on the market.

An object of the invention is to provide a tool-less, easy-to-use, adapter that can quickly, accurately, securely, and concentrically attach a muzzle device, such as a suppressor or suppressor extension to the barrel of a firearm.

It is another object of the invention to provide an adapter that is far less costly to manufacture due to a one size fits all system, and to eliminate the need to manufacture hundreds of sizes and configurations.

In addition, it is an object of this invention to provide an adapter, which can be secured to or integrated with a muzzle device, such as a suppressor and/or a suppressor extension; and provide an adapter that has the ability to attach to one or multiple firearm accessories, including, but not limited to a bipod, an iron sight, a sling mount, a rail for mounting accessories, a hand guard for installation from barrel heat, a forward grip, a flashlight, and a laser.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is a firearm adapter configured to fit most gun barrels. The adapter preferably attaches to the smooth section of a barrel and doesn't require any tooling or permanent modification to the barrel for securement of the adapter to a firearm. The ability of the present invention to attach to a variety of gun barrels reduces the costs associated with manufacturing, packaging, labeling, and stocking because a single adapter of the present invention can replace thousands of different muzzle device/suppressor and muzzle device/suppressor adapter designs. The following description will reference suppressors and integrated suppressors rather than using the broader terms "muzzle devices," however, the adapters described herein will work with any firearm accessories generally designed to attach or extend from a muzzle end of a firearm, which are referred to herein as "muzzle devices."

Figure 1:
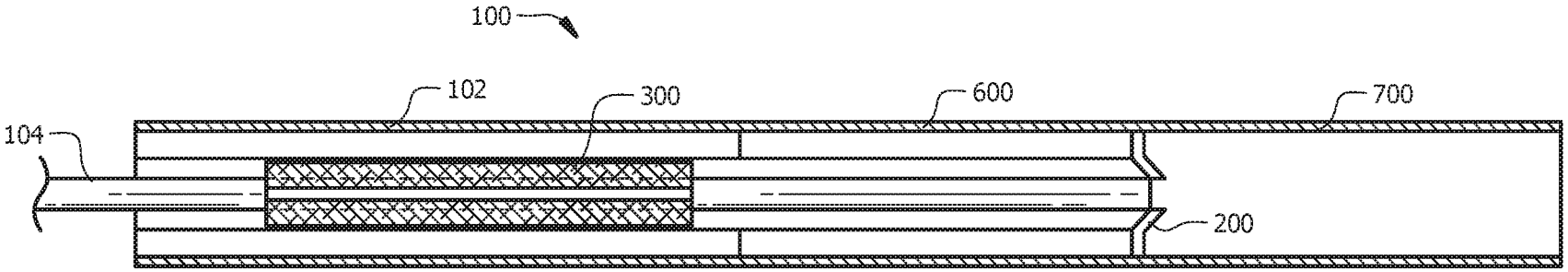
FIG. 1 is a sectional elevation view of an embodiment of the present invention.

As shown in FIG. 1, an embodiment of firearm adapter 100 includes an attachable or integrated suppressor 700 and/or suppressor extension 600. Adapter 100 is configured to ensleeve and easily compress around barrel 104. An embodiment may include fitment sleeve 300 to effectively increase the diameter of barrel 104. As a result, adapter 100 can establish a proper amount of compression force around barrel 104 to ensure that adapter 100 remains fixed to barrel 104 during use of the firearm.

Figure 2:
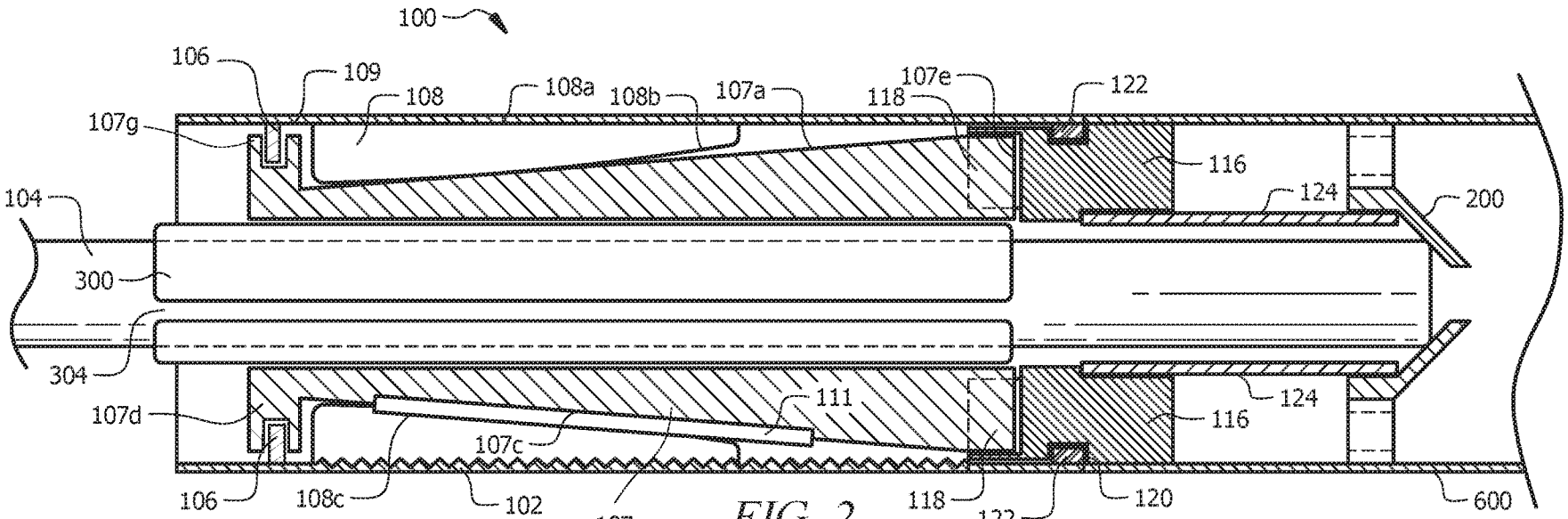
FIG. 2 is a sectional elevation view of an embodiment of the present invention highlighting the internal mechanisms of the adapter.

Referring now to FIG. 2, an embodiment of adapter 100 includes first sheath 102 housing a generally cylindrical, but tapered compression collar 108 and at least partially housing a generally cylindrical, but tapered constricting sleeve 107. Compression collar 108 is sandwiched between sheath 102 and constricting sleeve 107. Moreover, first sheath 102 is in rotational communication with second sheath 103, an integrated suppressor 700, or an integrated suppressor extension 600. The latter is depicted in FIG. 2.

Figure 3:
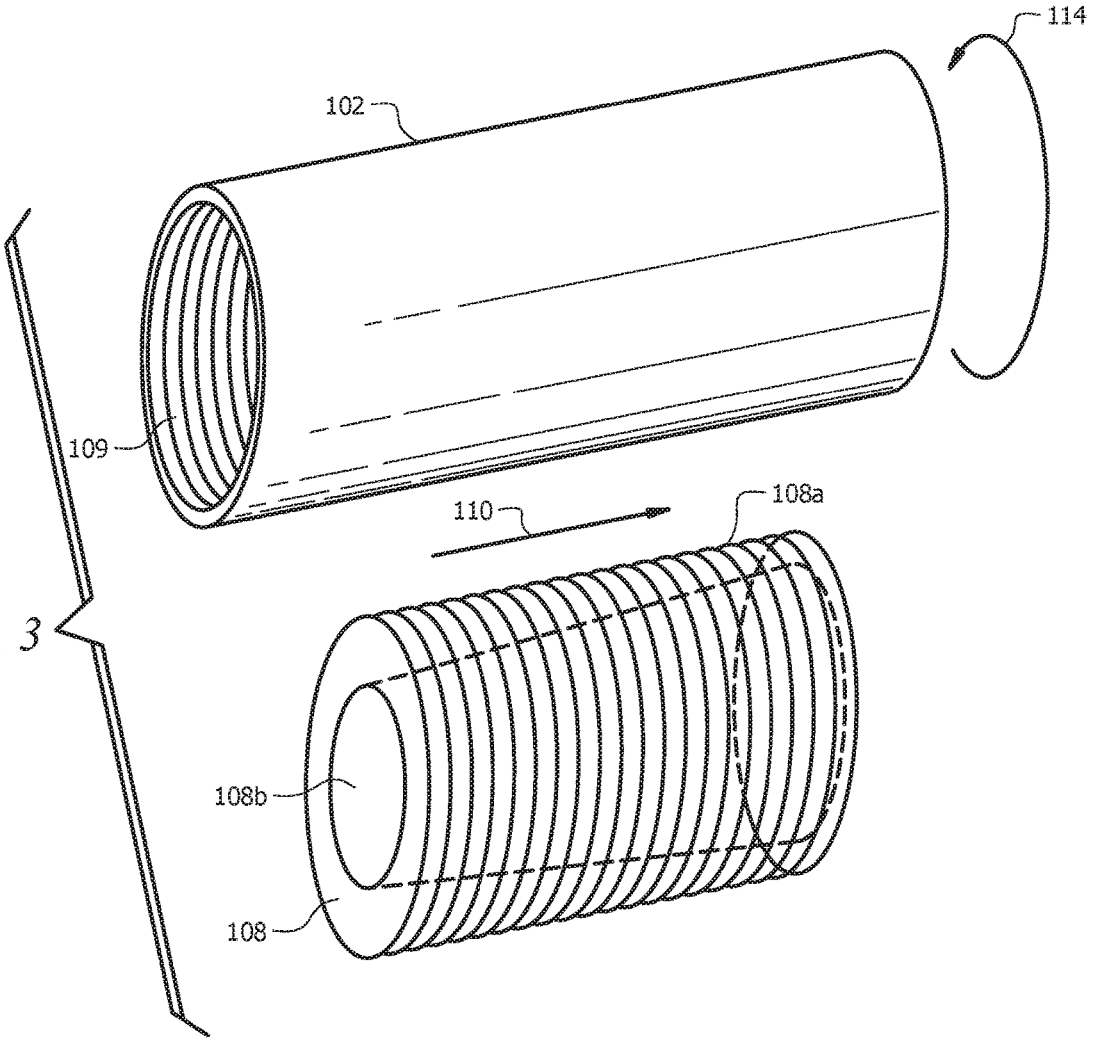
FIG. 3 is an exploded view of an embodiment of the present invention showing the outer rotatable sheath and the compression collar.

As depicted in FIGS. 2-3, an embodiment of first sheath 102 includes threaded internal surface 109. Outer surface 108*a* of compression collar 108 is inversely threaded with respect to internal surface 109 and in contact with said surface, such that rotation of first sheath 102, as depicted by arrow 114, causes linear translation of compression collar 108 in a direction parallel to the longitudinal axis of adapter 102, as depicted by arrow 110. It should be noted that while threads are circumferentially present on internal surface 109, the threads are not shown on the top half in FIGS. 2 and 5 to provide an additional level clarity.

Figure 4:
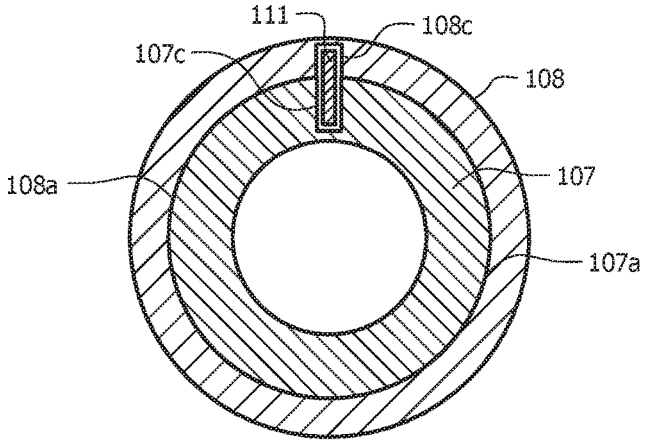
FIG. 4 is a cross-sectional view an embodiment of the present invention highlighting the key residing within the key slots of the compression collar and the constricting sleeve.

As best depicted in FIG. 4, compression collar 108 further includes key slot 108*c* disposed in internal surface 108*b*. Key slot 108*c* is radially aligned with key slot 107*c* in outer surface 107*a* of constricting sleeve 107. In conjunction, key slots 107*c*, 108*c* received key 111. Key 111 prevents rotation of compression collar 108 with respect to constricting sleeve 107. Prevention of rotation of compression sleeve 108 with respect to constricting sleeve 107 helps compression collar 108 to travel in a linear direction when first sheath 102 is rotated.

In an embodiment, compression collar 108 is radially integrated into first sheath 102 and inner surface 108*b* of compression collar 108 is in threaded communication with outer surface 107*a* of constricting sleeve 107. This arrangement will also allow for the liner translation of compression collar 108 when sheath 102 is rotated.

Referring back to FIG. 2-3, inner surface 108*b* of compression collar 108 is tapered such that a second end (proximal end in FIGS. 2-3) has an inner diameter less than the inner diameter at the first end (distal end in FIGS. 2-3). Conversely, outer surface 107*a* of restricting sleeve 107 is tapered such that a first end (proximal end in FIGS. 2-3) has an outer diameter greater than the outer diameter at the second end (distal end in FIGS. 2-3). The direction of the taper of compression collar 108 and direction of the taper of constricting sleeve 107 are inversely oriented with respect to each other, such that tapered inner surface 108*b* of compression collar increases in diameter in a first direction (a distal direction in the embodiment shown in FIG. 2) and 108 tapered outer surface 107*a* of constricting sleeve 107 increases in diameter in the first direction.

The rotation of sheath 102 in a first direction (depicted by arrows 114 in FIG. 5), and the resulting linear travel of compression collar 108 in the first direction (a distal direction in the embodiment shown in FIG. 2, exemplified by arrow 110 in FIG. 5) produces a radial compression force (depicted by arrows 112) as compression collar 108 moves along outer surface 107*a* of constricting sleeve 107 towards distal end 107*e* of constricting sleeve 107. As compression collar 108 moves towards distal end 107*e* of constricting sleeve 107, the combined thickness of compression collar 108 and constricting sleeve 107 increases, and because sheath 102 is rigid, constricting sleeve 107 is forced inwardly towards the longitudinal axis of barrel 104. In other words, internal surface 107*b* of constricting sleeve 107 reduces in diameter compressing around barrel 104, or fitment sleeve 300 if used.

Figure 5:
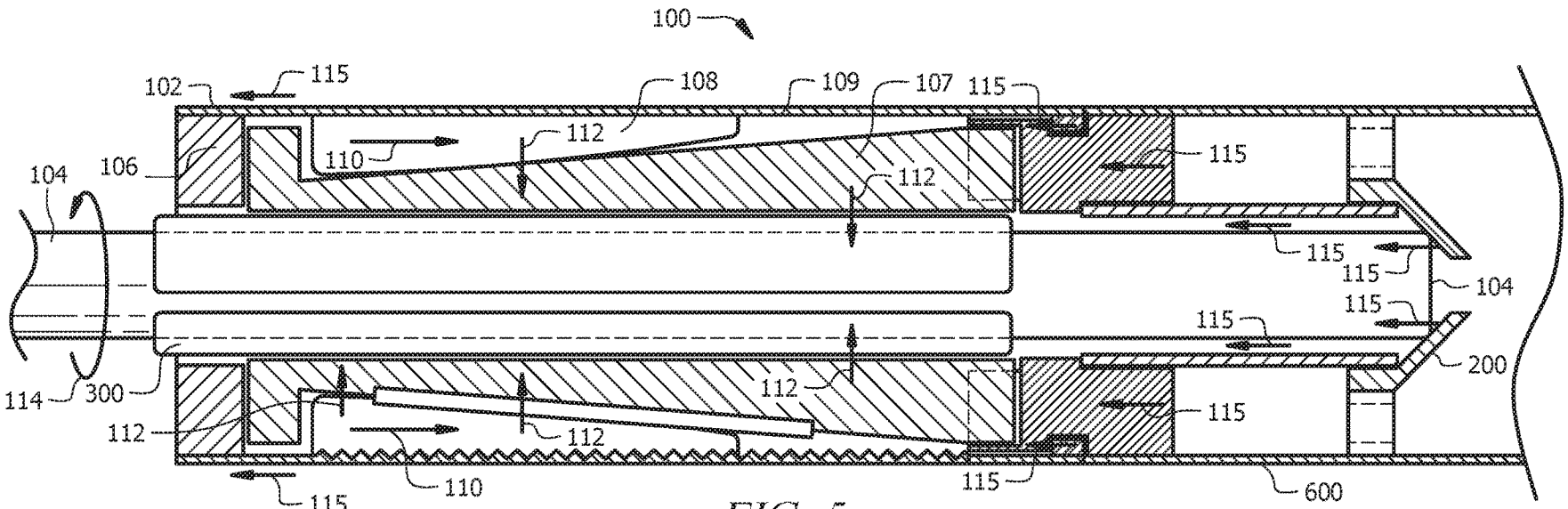
FIG. 5 is a sectional elevation view of an embodiment of the present invention highlighting the internal mechanisms of the adapter with force arrows.

Correspondingly, rotation of sheath 102 in a second direction, opposite the first, will result in compression collar 108 linearly traveling in a second direction—the proximal direction in the exemplified embodiments in FIGS. 2 and 5. The thicker portions of compression collar 108 and constricting sleeve 107 move away from each other and the compression force on barrel 104 and/or fitment sleeve 300 reduces in magnitude.

Constricting sleeve 107 is adapted to yield under compression force such that inner surface 107*b* reduces in diameter. Moreover, constricting sleeve 107 is adapted the return to its original shape upon the removal of compression force. Thus, constricting sleeve 107 is preferably made of a flexible yet resilient material.

Figure 6:
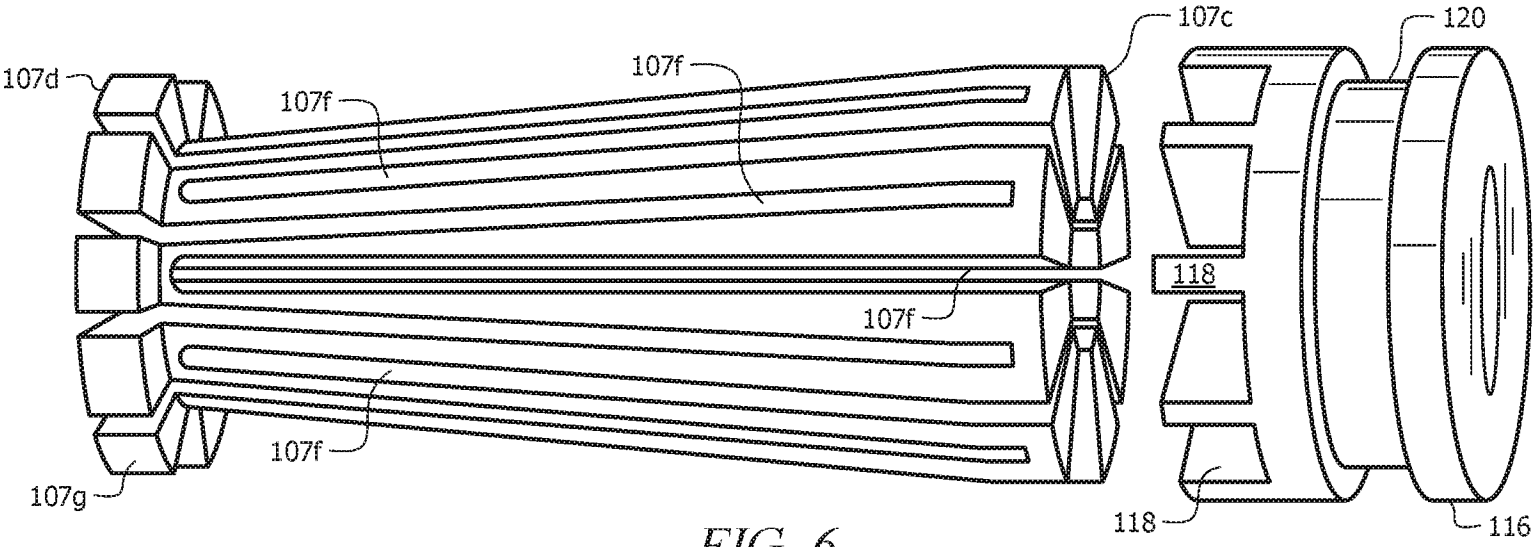
FIG. 6 is an exploded view of an embodiment of the present invention highlighting the constricting sleeve and the force transferring collar.

In an embodiment, as depicted in FIG. 6, constricting sleeve 107 has a discontinuous perimeter at both the proximal and distal ends 107*d*, 107*e*. The discontinuous nature is achieved through expansion/contraction adjustment slots 107*f*. Adjustment slots 107*f* preferably extend along the majority of the length of constricting sleeve 107 thereby providing the necessary circumferential gaps to reduce the diameter of constricting sleeve 107.

In an embodiment, proximal end 107*d* includes an outwardly extending annular flange 107*g*. Annular flange 107*g* works in conjunction with an inwardly projecting annular rim 106 near the proximal end of adapter 100 to prevent constricting sleeve 107 from exiting the proximal end of sheath 102. Annular rim 106 also has a central bore for receiving barrel 104, and fitment sleeve 300 if one is needed. As depicted in FIG. 2, annular rim 106 is radially aligned with a portion of annular flange 107*g* and is adapted to insert into an annular groove in annular flange 107*g* to also help prevent constricting sleeve 107 from binding with force transfer collar 116. Alternatively, as depicted in FIG. 5, annular rim 106 is longitudinally spaced from constricting sleeve 107 providing a simple backstop to prevent constricting sleeve 107 from exiting the proximal end of sheath 102.

Figure 7:
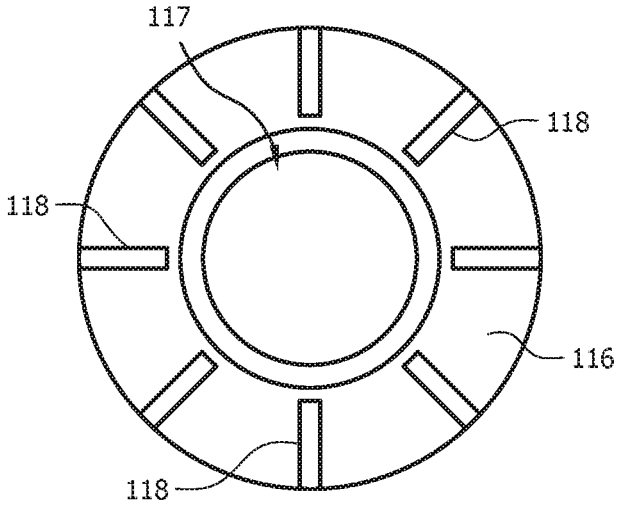
FIG. 7 is an end view of the force transferring collar.
Figure 8A:
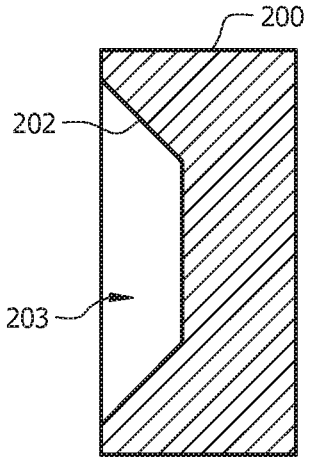
FIG. 8A is a side sectional view of an embodiment of the barrel guide.
Figure 8B:
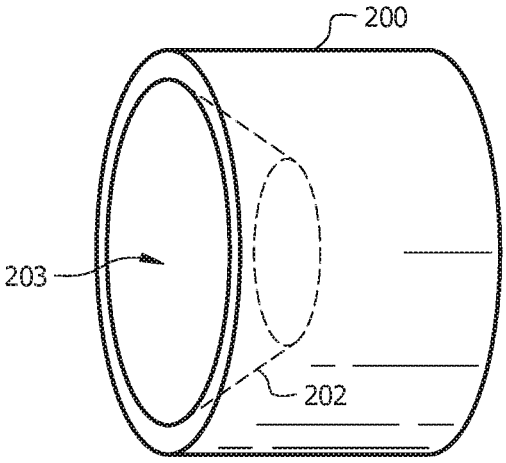
FIG. 8B is a perspective view of an embodiment of the barrel guide.
Figure 9A:
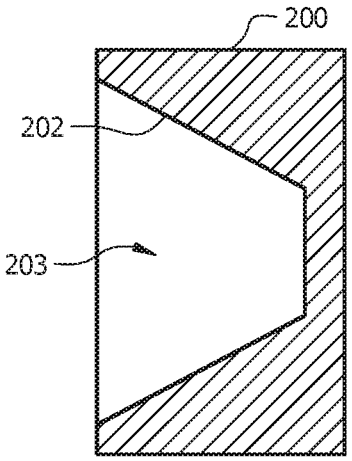
FIG. 9A is a side sectional view of an embodiment of the barrel guide.
Figure 9B:
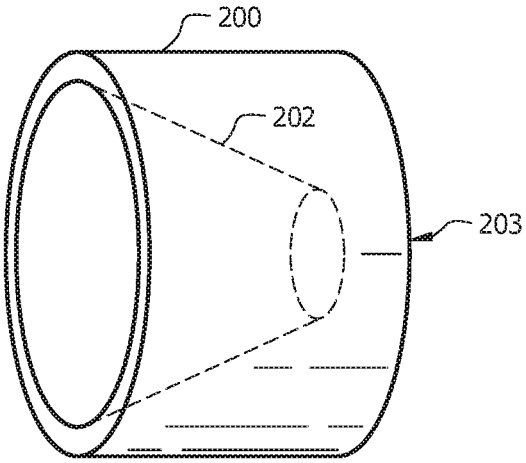
FIG. 9B is a perspective view of an embodiment of the barrel guide.
Figure 10:
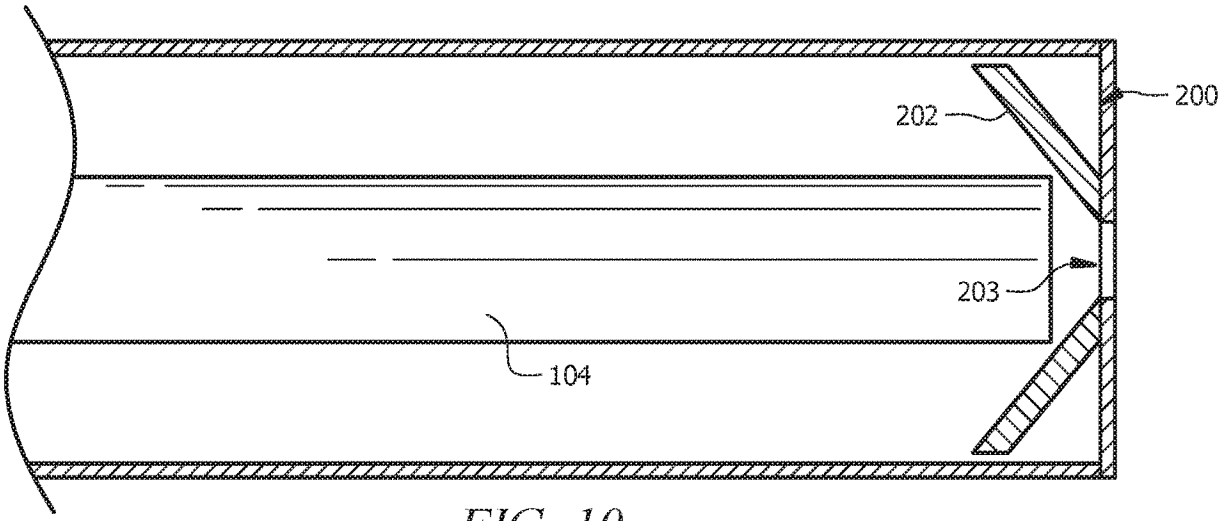
FIG. 10 is a side sectional view of an embodiment of the barrel guide secured within a second sheath.
Figure 11:
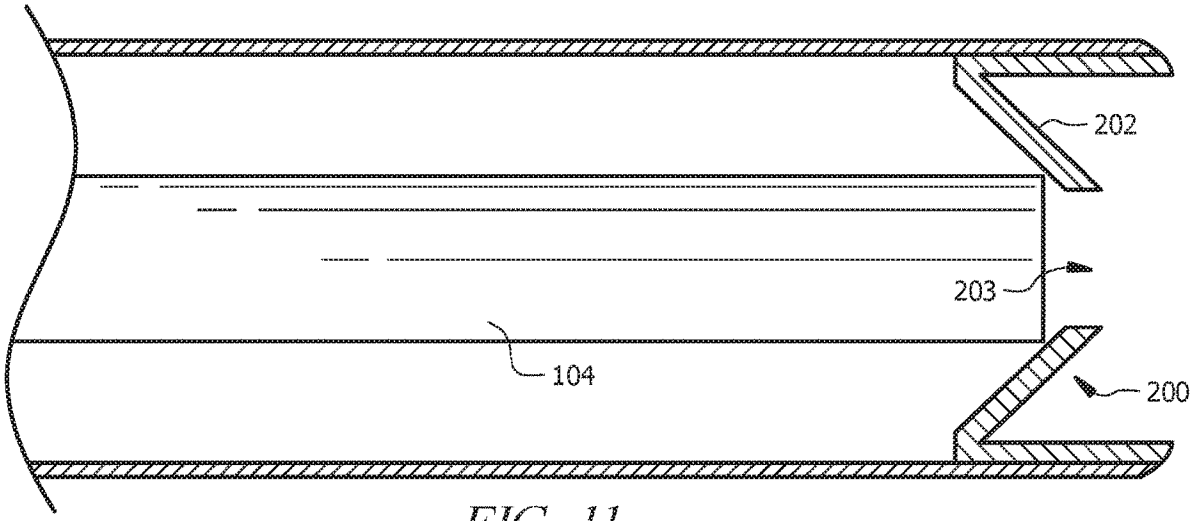
FIG. 11 is a side sectional view of an embodiment of the barrel guide secured within a second sheath.

In the exemplary embodiment in FIGS. 2 and 6, adjustment slots 107*f* serve an additional purpose. At distal end 107*e*, adjustment slots 107*f* receive flanges 118 extending from force transfer collar 116 in an axial direction, which is best depicted in FIGS. 6-7. Flanges 118, however, are preferably sized to avoid having a significant effect on the constricting sleeve's ability to radially compress.

Force transfer collar 116 is fixed to second sheath 103, an integrated suppressor 700, or an integrated suppressor extension 600 (the latter is depicted in FIG. 2). As a result, force transfer collar 116 is rotationally fixed with respect to second sheath 103, an integrated suppressor 700, or an integrated suppressor extension 600. The interconnection of flanges 118 and adjustment slots 107*f* in turn prevent rotation of constricting sleeve 107 with respect to second sheath 103, an integrated suppressor 700, or an integrated suppressor extension 600; and key 111 prevents rotation of compression collar 108 with respect to constricting sleeve 107. Therefore, force transfer collar effectively prevents rotation of compression collar 108 when sheath 102 is rotated, which enables compression collar 108 to travel in a linear direction when sheath 102 is rotated.

As depicted in FIG. 7, force transferring collar 116 includes a central bore 117 sized to receive barrel 104. Preferably, force transferring collar 116 has an inner diameter equal to the inner diameter of constricting sleeve 107 when constricting sleeve 107 is free of any compression forces, i.e. in a position of repose.

Referring back to FIG. 2, an embodiment of force transferring collar 116 includes an annular notch 120 between flanges 118 and the distal end of force transferring collar 116. Annular notch 120, preferably freely, receives retention ring 122 secured to sheath 102. Retention ring 122 in combination with annular notch 120 keeps sheath 102 rotationally secured to second sheath 103, an integrated suppressor 700, or an integrated suppressor extension 600. Retention ring 122 may include or be comprised of bearings to reduce the friction during rotation of sheath 102.

An embodiment of adapter 100 may also include barrel guide 200. As illustrated in FIG. 2, barrel guide 200 may be in mechanical communication with force transferring collar 116 through structural member 124 and/or may be secured directly to second sheath 103, an integrated suppressor 700, or an integrated suppressor extension 600.

Barrel guide 200 allows a user to quickly and efficiently install and align adapter 100 to gun barrel 104. Barrel guide 200 is adapted to guide the muzzle into alignment with second sheath 103, an integrated suppressor 700, or an integrated suppressor extension 600 using, for example, distally and inwardly angled walls 202. Walls 202 extend inwardly enough to catch the muzzle of barrel 104 without extending far enough towards the longitudinal axis to impede a bullet exiting barrel 104.

As depicted in FIGS. 8-11, barrel guide 200 preferably has a frustoconical-shaped bore 203 to guide barrel 104, but may have any curved or angled walls shaped to funnel barrel 104 towards central bore 203 when subject to an axial force causing barrel 104 to contact barrel guide 200. Barrel guide 200 can be as simple as a hollow cone shaped device built with various angles preferably between 10 and 80 degrees. Barrel guide 200, used in conjunction with the concentric tightening of constricting sleeve 107 results in an adapter perfectly aligned to the barrel of the firearm. No tools or extra effort are required.

Barrel guide 200 provides extreme flexibility in that it will align any size barrel that falls between the outside diameter of conical bore 203 and the inside diameter of conical bore 203. In an embodiment, barrel guide 200 may threadedly engage and disengage or may be secured directly to structural member 124 and/or to second sheath 103, an integrated suppressor 700, or an integrated suppressor extension 600. This temporary attachment allows barrel guide 200 to be modified as need to provide a properly sized barrel guide 200 based on the barrel diameter. A single cone, however, will fall easily within the common minimum barrel size of 0.55 and the common maximum barrel size of 1.05.

Figure 12A:
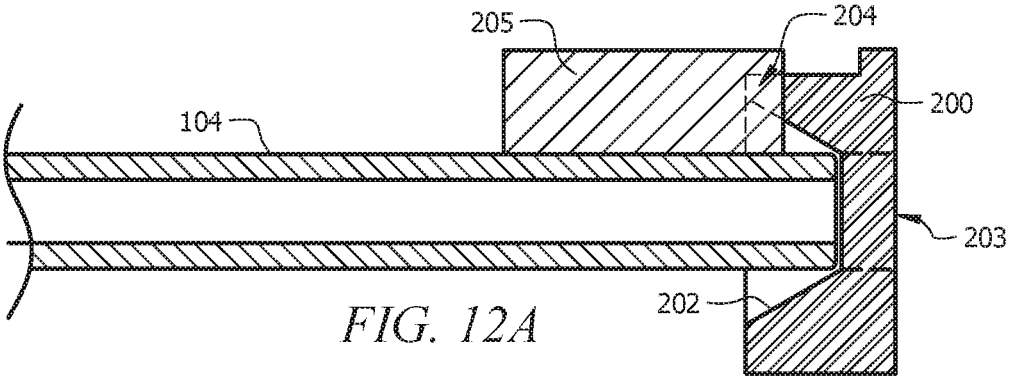
FIG. 12A is a side sectional view of an embodiment of the barrel guide with a cutout for iron sights.
Figure 12B:
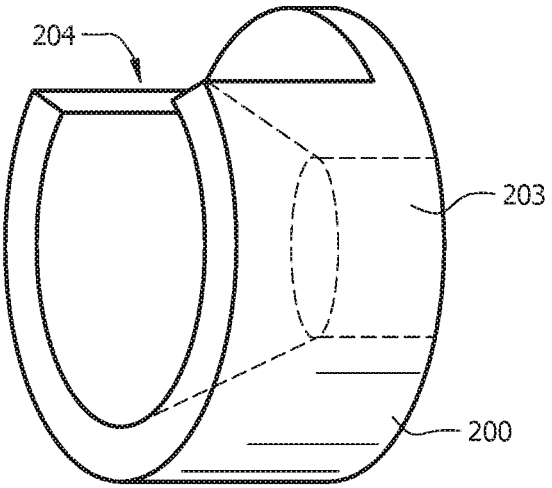
FIG. 12B is a perspective view of an embodiment of the barrel guide with a cutout for iron sights.
Figure 12C:
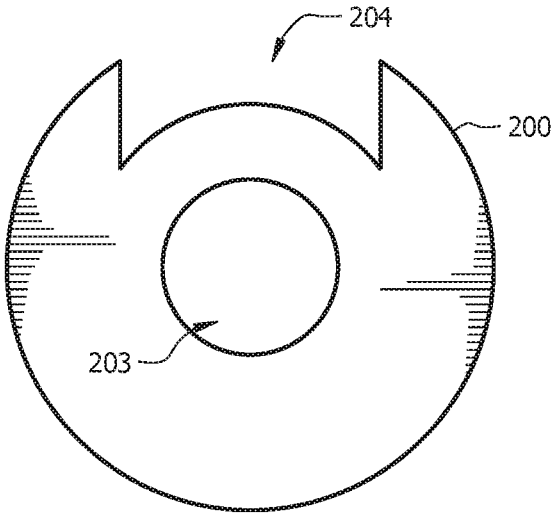
FIG. 12C is an end view of an embodiment of the barrel guide with a cutout for iron sights.
Figure 13:
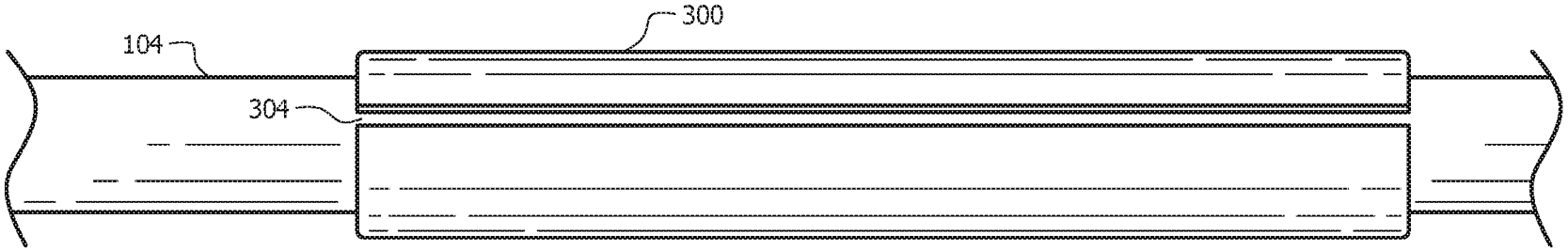
FIG. 13 is a side view depicting an embodiment of the fitment sleeve secured to a barrel.

Referring now to FIG. 12, an embodiment of barrel guide 200 includes cutout 204 for iron sights 205 in the proximal end of barrel guide 200. Such an embodiment preferably includes a vertical alignment indicator to inform a user of the location of the cutout 204 within second sheath 103, an integrated suppressor 700, or an integrated suppressor extension 600.

Barrel guide 200 comprises of a heat resistant, preferably flexible material for flexibly shaping to the muzzle. The flexibility helps form a tight seal with the muzzle. Alternatively, an embodiment may include a mechanical biasing member around the conical bore. As the cone is pushed against the muzzle, the spring compresses to form a tight seal and to facilitate perfect alignment. The spring can be placed in various positions and placements around the barrel guide to achieve compression. This seal is particularly important to prevent gas from escaping the suppressor and/or extension in a proximal direction and exiting the proximal end of outer sheath 102.

Barrel guide 200 can stand alone within adapter 100 or be integrated with the fitment sleeve, constricting sleeve, second sheath 103, an integrated suppressor 700, or an integrated suppressor extension 600.

Referring back to FIG. 5, barrel guide 200 also provides the necessary frontal stop to fix adapter 100 in place when adapter 100 is tightened around barrel 104. As sheath 102 is rotated in direction 114, compression collar 108 is forced towards distal end 107*e* of constricting collar 107 in accordance with directional arrow 110. The combined thickness of compression collar 108 and constricting sleeve 107 is met by internal surface 109 of sheath 102 and constricting sleeve 107 compresses in an inwardly direction depicted by directional arrows 112. After a certain amount of rotation of sheath 102, internal surface 107*b* of constricting sleeve 107 will compress into barrel 104, or fitment sleeve 300. Once constricting sleeve 107 and compression collar 108 can no longer move radially due to the compression force, further rotation of outer sheath 102 in accordance with rotational arrow 114 will cause outer sheath 102 to translate in the proximal direction, opposite of the direction of travel of compression collar 108, as depicted by arrows 115. Retention ring 122 will in turn pull force transfer collar 116 according to directional arrows 115. Because force transfer collar 116 is in mechanical communication with barrel guide 200, either through structural member 124, second sheath 103, integrated suppressor 700, and/or integrated suppressor extension 600 (the latter is depicted in FIG. 5), barrel guide 200 will also be pulled in the proximal direction as depicted by arrows 115 until barrel 104 contacts barrel guide 200 to securely aligned barrel 104 with adapter 100. In other words, adapter 100 is a self-aligning adapter.

Referring now to FIGS. 13-17, fitment sleeve 300 provides an inexpensive and highly variable means for fitting a single size adapter to most firearms without having to modify barrel 104. Fitment sleeve 300 preferably includes self-adjusting gap 304 along the length of fitment sleeve 300. Gap 304 allows fitment sleeve 300 to adjust to fit a wider range of firearm barrels. Moreover, as constriction sleeve 107 adds pressure to fitment sleeve 300, gap 304 allows fitment sleeve 300 to adjust to manufacturing differences in barrel diameter of multiple tenths, hundreds and thousandths of an inch through the narrowing and widening of gap 304 without further effort on the part of the operator.

Figure 14A:
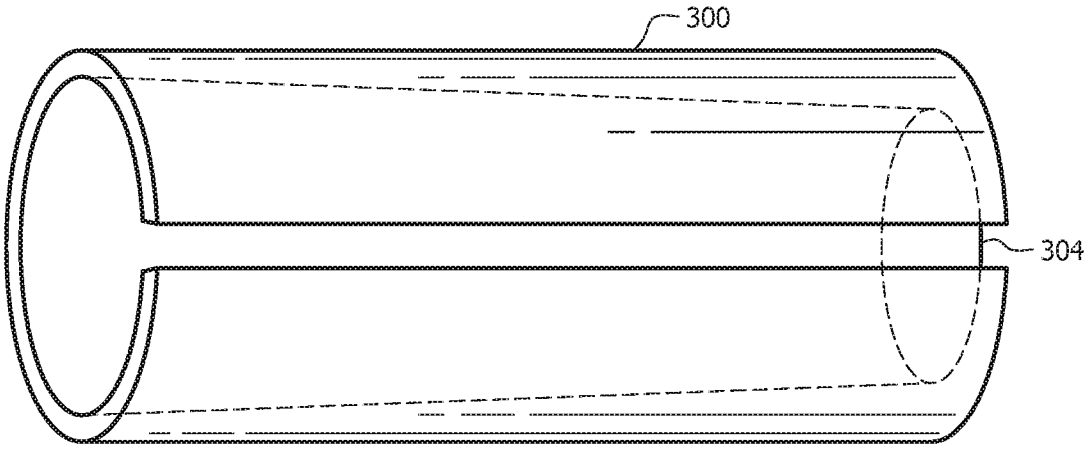
FIG. 14A is a perspective view depicting an embodiment of the fitment sleeve.
Figure 14B:
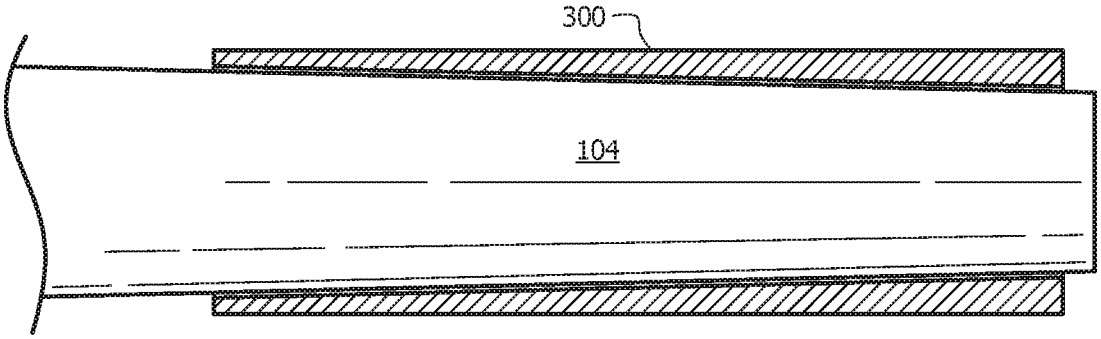
FIG. 14B is a side sectional view depicting an embodiment of the fitment sleeve secured to a barrel.

As depicted in FIG. 14, this same process is applicable for tapered barrels through a tapered version of fitment sleeve 300. In an embodiment, gap 304 may widen at the rear and narrow at the front to allow perfect fitment of adapter 100 to barrel 104.

Figure 15:
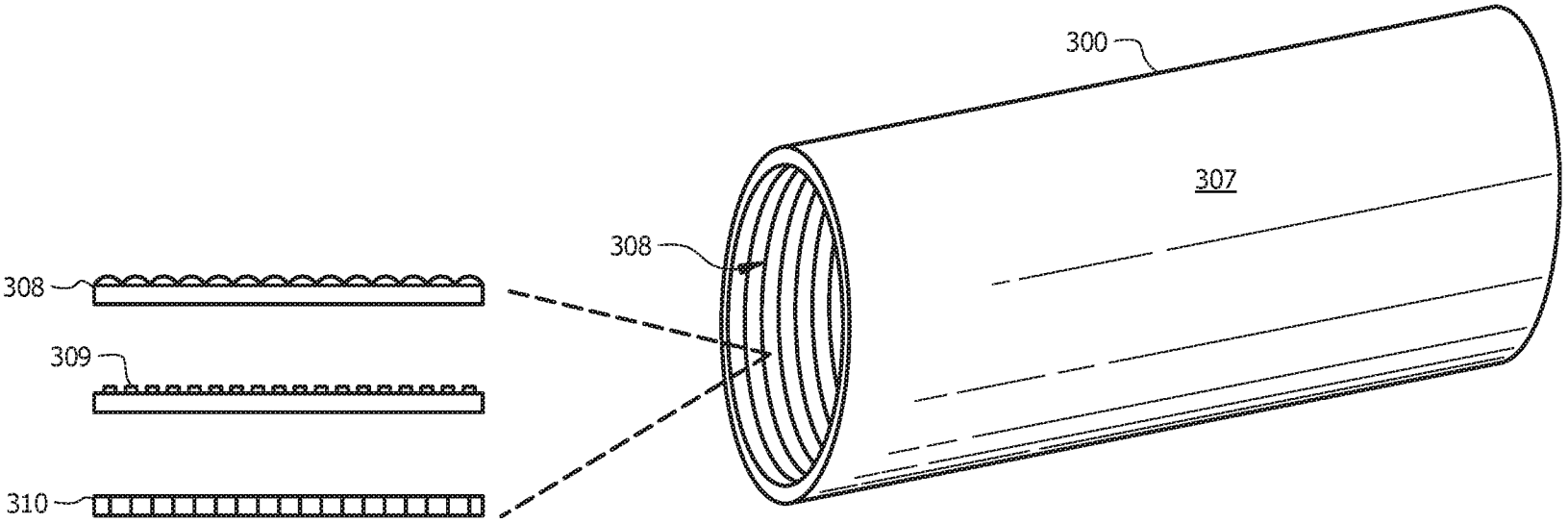
FIG. 15 is a perspective view depicting an embodiment of the fitment sleeve.

As depicted in FIG. 15, fitment sleeve 300 may further provide a secure gripping surface using e.g. grooves 308, ridges 309, or slits 310, on outer surface 307 and/or inner surface 308 of sleeve 300, for a more secure attachment of adapter 100 to a smooth metallic gun barrel.

Figure 16A:
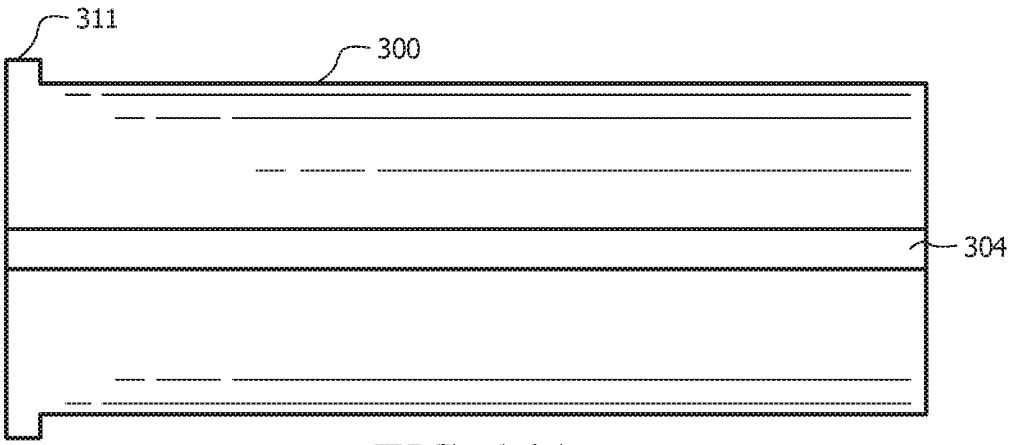
FIG. 16A is a side view depicting an embodiment of the fitment sleeve.
Figure 16B:
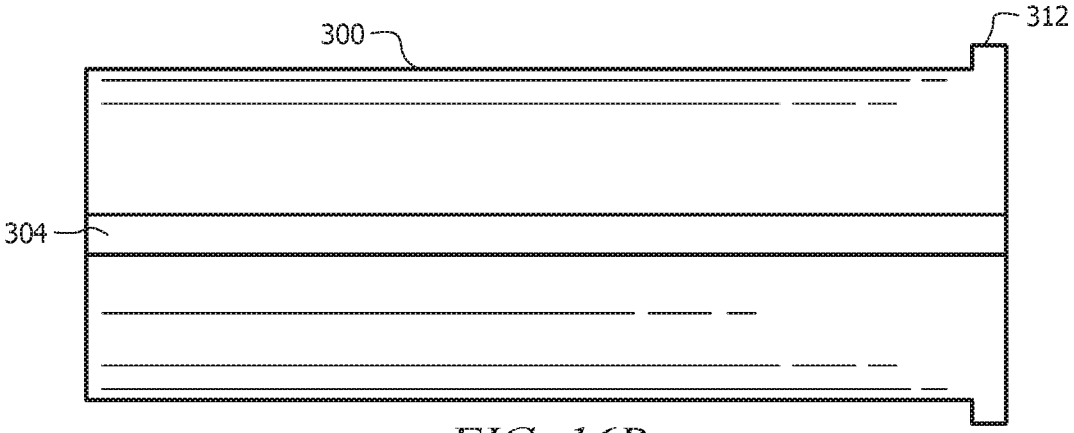
FIG. 16B is a side view depicting an embodiment of the fitment sleeve.

Referring now to FIG. 16, an embodiment may include annular stop 311 at the proximal end of fitment sleeve 300 to help secure the location of fitment sleeve 300 with respect to adapter 100. Alternatively, or in addition to, an embodiment may include annular stop 312 at the distal end of fitment sleeve 300 to help secure the location of fitment sleeve 300 with respect to adapter 100.

Figure 17:
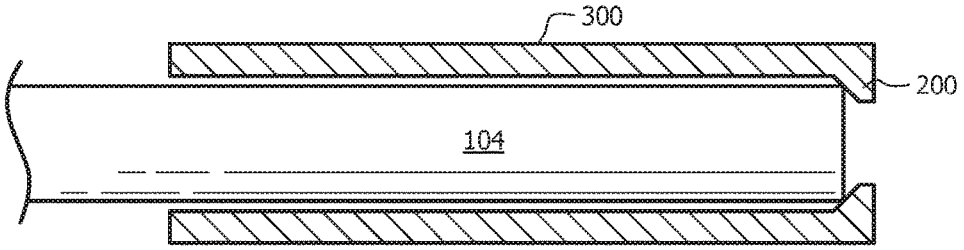
FIG. 17 is a side sectional view depicting an embodiment of the fitment sleeve secured to a barrel.

Referring to FIG. 17, an embodiment of fitment sleeve 300 may include barrel guide 200 integrated into the distal end of fitment sleeve 300 to help secure the location of fitment sleeve 300 with respect to adapter 100 while also aligning barrel 104 with adapter 100.

As depicted in FIG. 18, embodiments may integrate several parts to reduce the costs associated with manufacturing and assembly. An embodiment may include compression collar 108 radially integrated into or secured to sheath 102, such that the outer surface of compression collar 108*a* is the outer surface of sheath 102. A distal end of sheath 102 is in threaded communication with second sheath 103, an integrated suppressor 700, or an integrated suppressor extension 600 (the second sheath is depicted in FIG. 18).

Constricting sleeve 107 may be integrated into sheath 103 through the attachment or integration of distal end 107*e* to sheath 103. Proximal end 107*d* has a discontinuous perimeter achieved through expansion/contraction adjustment slots 107*f*. Adjustment slots 107*f* establish a plurality of free ends, which can flex under compression force to constrict around barrel 104. Adjustment slots 107*f* preferably extend along the length of constricting sleeve 107 thereby providing the necessary circumferential gaps to reduce the diameter of constricting sleeve 107. In addition, inner surface 107*b* is preferably curved to provide a more linear inner surface when compressed towards the longitudinal axis.

Barrel guide 200 is also integrated into sheath 103 by simply tapering the inner surface towards aperture 203. The embodiment further includes threaded suppressor attachment 702 on which a suppressor can be attached. Alternatively, suppressor 700, or suppressor extension 600 can be integrated with the distal end of sheath 103.

Figure 18A:
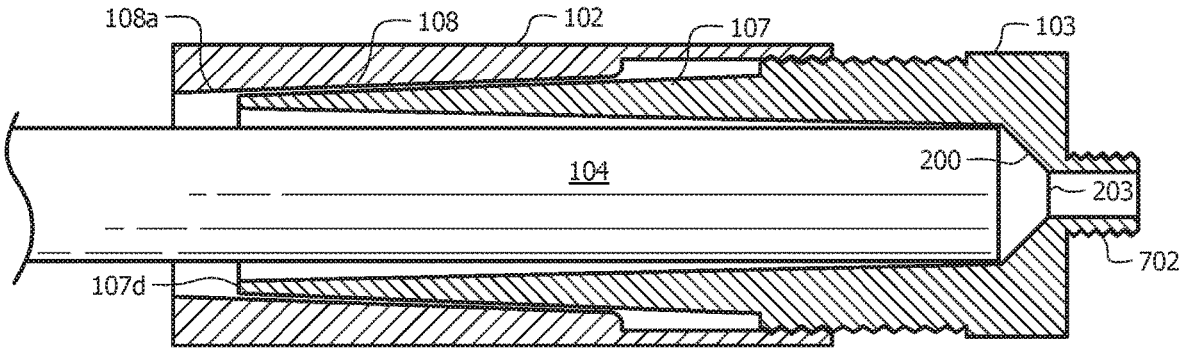
FIG. 18A is a sectional elevation view of an embodiment of the present invention highlighting the internal mechanisms of the adapter.
Figures 18B, 18C:
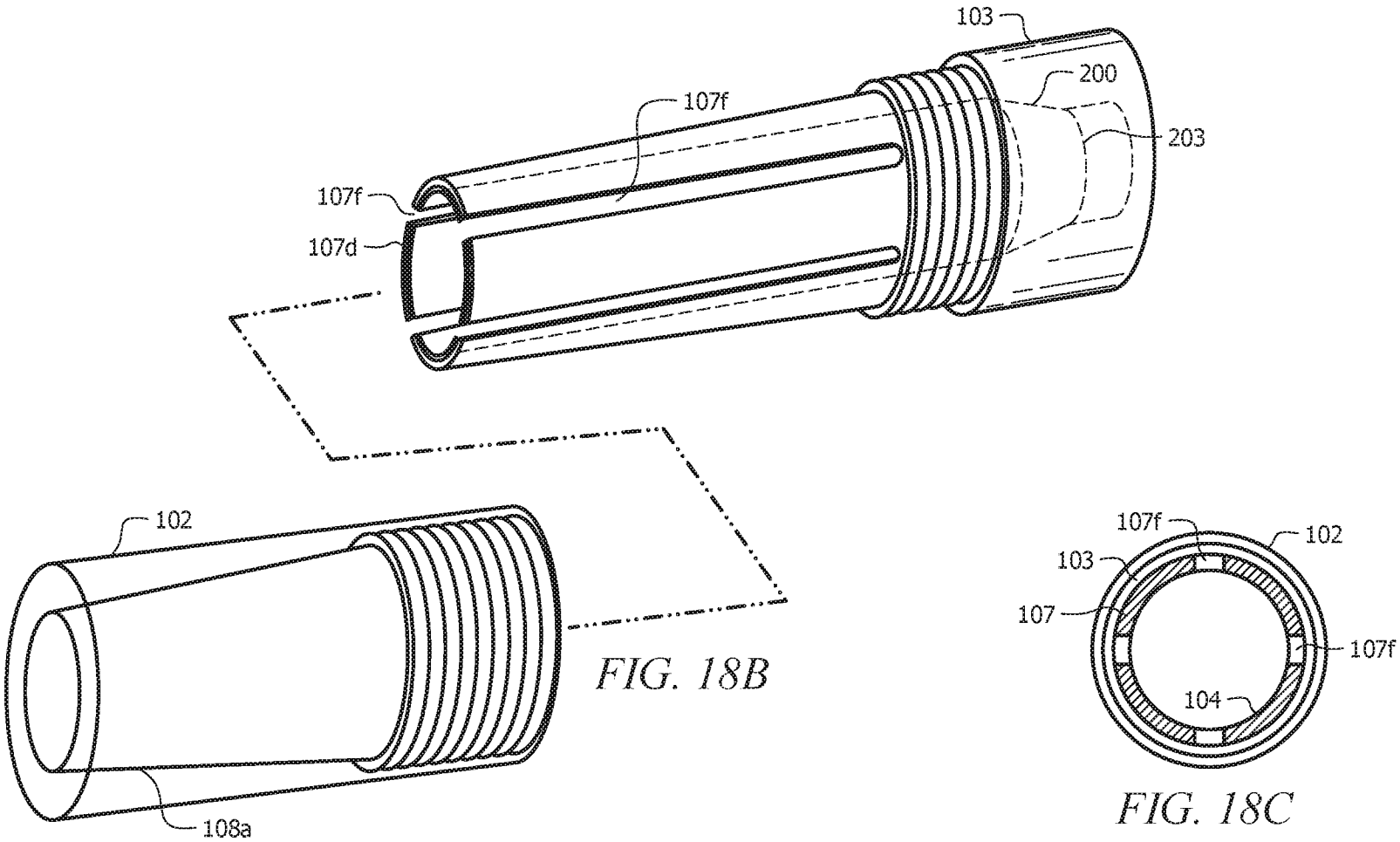
FIG. 18B is a partial exploded view of an embodiment of the present invention highlighting the connection between the first and second sheaths.
FIG. 18C is an end view of the embodiment in FIG. 18A.
Figure 18D:
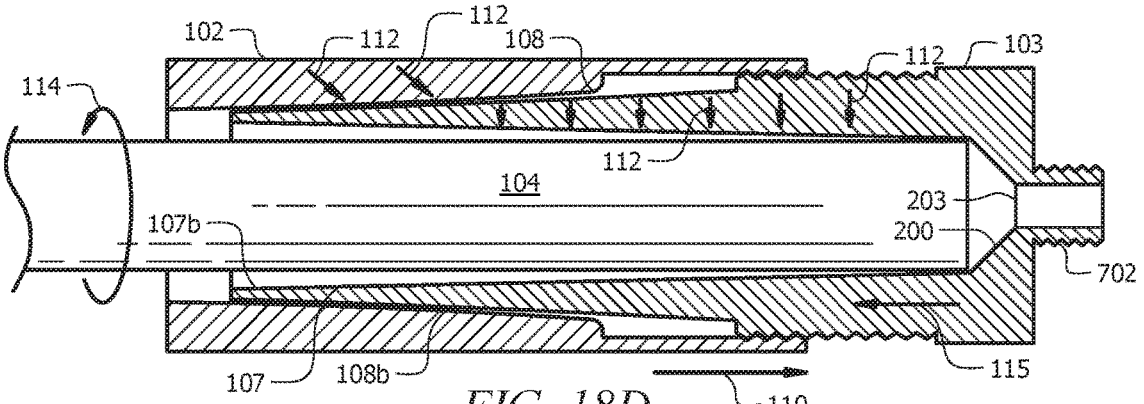
FIG. 18D is a sectional elevation view of an embodiment of the present invention highlighting the internal mechanisms of the adapter with force arrows.

Referring now specifically to FIG. 18*d*, as sheath 102 is rotated in direction 114, the threaded engagement with sheath 103 causes sheath 102 and its integrated compression collar 108 to translate in a linear direction towards the distal end of sheath 103, as depicted by arrow 110. The tapered inner surface 108*b* of compression collar 108 applies a compression force, depicted by arrows 112, which is applied to constricting sleeve 107 and ultimately barrel 104. After a certain amount of rotation of sheath 102, internal surface 107*b* of constricting sleeve 107 will compress into barrel 104, or fitment sleeve 300 if used. Once constricting sleeve 107 and compression collar 108 can no longer move due to the compression force, further rotation of outer sheath 102 in accordance with rotational arrow 114 will force outer sheath 103 to translate in the proximal direction, opposite of the direction of travel of compression collar 108, as depicted by arrow 115. Because outer sheath 103 is in mechanical communication with barrel guide 200, barrel guide 200 will also be pulled in the proximal direction as depicted by arrows 115 until barrel 104 contacts barrel guide 200 to securely aligned barrel 104 with adapter 100. In other words, the adapter is a self-aligning adapter.

Figure 18E:
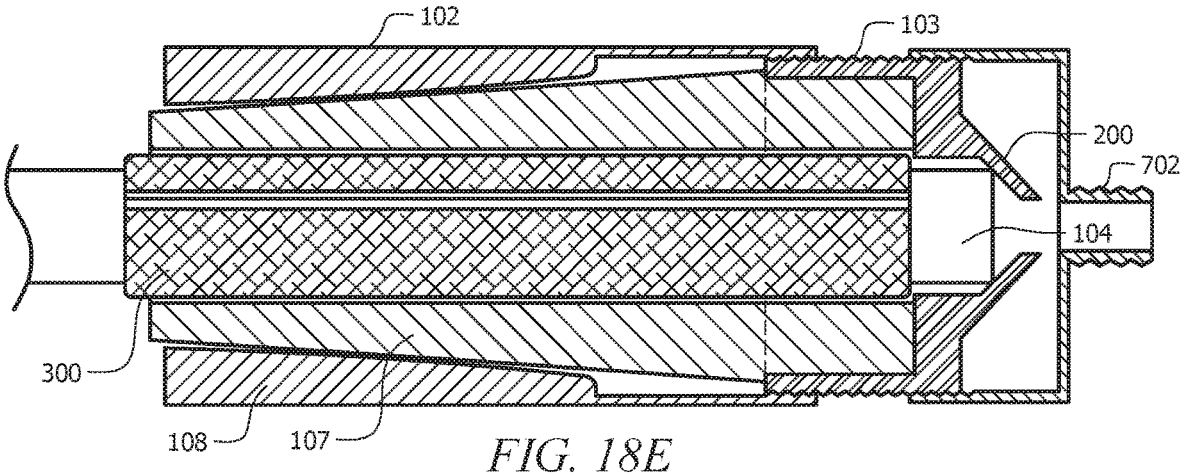
FIG. 18E is a sectional elevation view of an embodiment of the present invention.

Referring now to FIG. 18E, suppressor attachment 702 may be removably attachable to sheath 103, using e.g. the threads on the outer surface of sheath 103. As a result, threaded attachment 702 may be interchangeable with the adapter to account for suppressors with different size threading. This embodiment would be useable with any type of suppressor that relies on a threaded attachment.

Referring now to FIG. 19, an embodiment of the firearm adapter includes constricting sleeve 107 having a distally tapered outer surface. The proximal end remains discontinuous to establish an adjustable inner diameter and has an outer diameter greater than the inner diameter of sheath 102. The distal end of constricting sleeve 107 has a diameter less than the inner diameter of sheath 102. Thus, sheath 102 is sized to receive at least a portion of constricting sleeve 107.

The distal end of constricting sleeve 107 include threads 130 and sheath 102 includes threads 109 to engage threads 130 on constricting sleeve 107. As threads 109 engage threads 130, and sheath 102 is rotated with respect to constricting sleeve 107, sheath 102 further ensleeves constricting sleeve 107.

Sheath 102 preferably includes an inwardly tapered inner surface proximate its proximal end to engages the tapered outer surface of the constricting sleeve. The two tapered surfaces force the constricting sleeve to reduce in diameter and tightly engage firearm barrel 104.

Figure 19A:
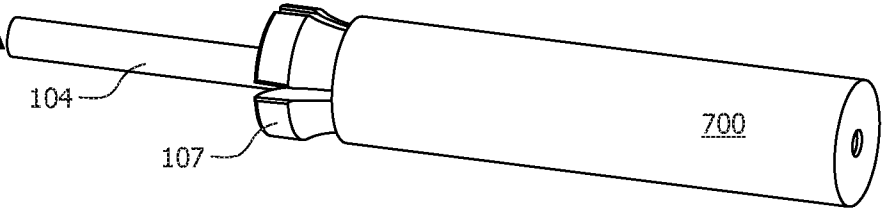
FIG. 19A is a perspective view of an embodiment of the present invention.
Figure 19B:
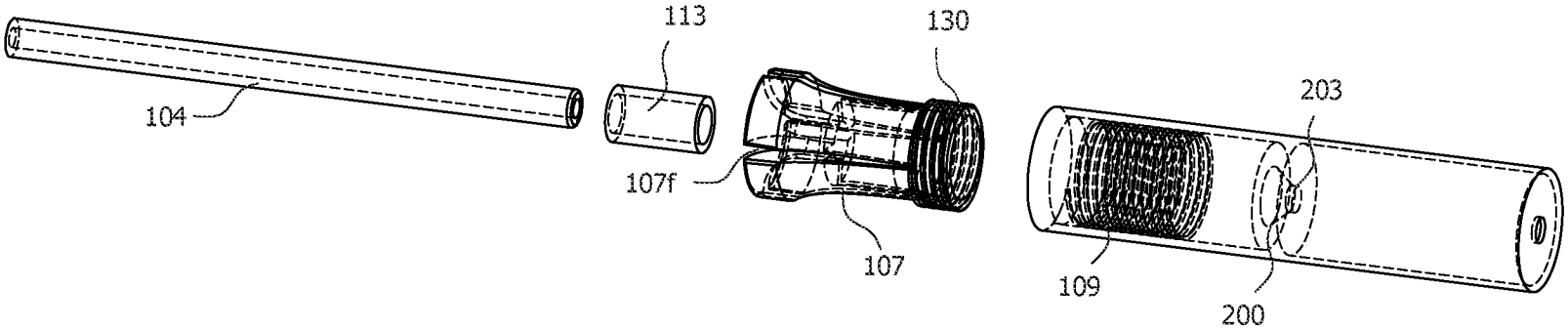
FIG. 19B is an exploded view of an embodiment of the present invention.
Figure 19C:
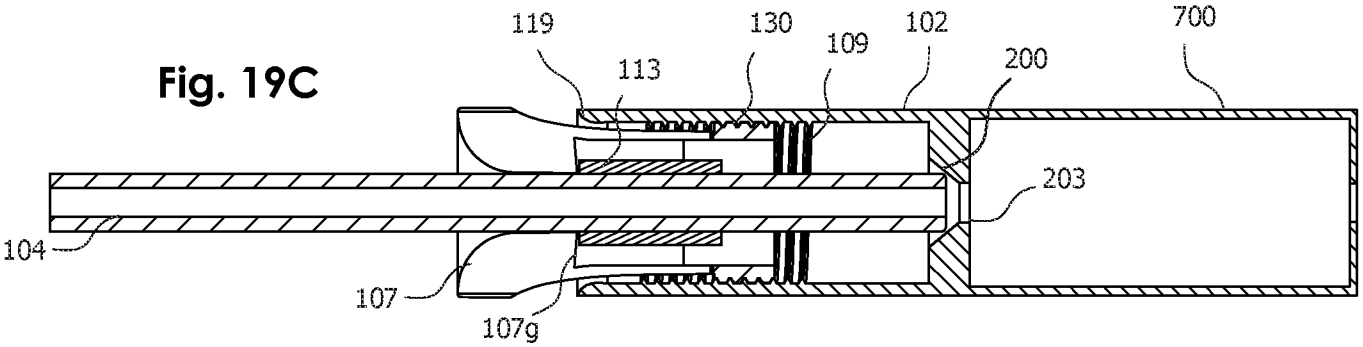
FIG. 19C is a sectional elevation view of an embodiment of the present invention highlighting the internal mechanisms of the adapter.

As shown in FIGS. 19B-19C, the adapter may work in conjunction with anchor 113 adapted to fixedly ensleeve firearm barrel 104. Anchor 113 may attach to firearm barrel 104 according to any methods and/or mechanism known to a person of ordinary skill in the art. Constricting sleeve 107 includes an inwardly extending catchment flange 107*g* which catches the proximal end of anchor 113 when constricting sleeve 107 is tightened around barrel 104. This engagement prevents the adapter from translating in a distal direction when the firearm is discharged. Preferably each arm of constricting sleeve 107, as established by the discontinuous perimeter, will include a catchment flange 107*g*, however, one or more equidistantly, circumferentially spaced flanges 107*g* will provide the necessary concentric alignment between constricting sleeve 107 and barrel 104.

An embodiment also includes barrel alignment guide 200 integrated into sheath 102. Barrel alignment guide 200 funnels firearm barrel 104 into axial alignment with a muzzle device that is either integrated with or attachable to sheath 102. It is considered, however, that certain embodiments may not need a barrel alignment guide as depicted in FIG. 19F. Preferably these embodiments will include muzzle stop 207 extending inwardly from sheath 102 to prevent barrel 104 from translating beyond a predetermined point within sheath 102. Muzzle stop 207 includes a centrally located projectile aperture 203.

Figure 19D:
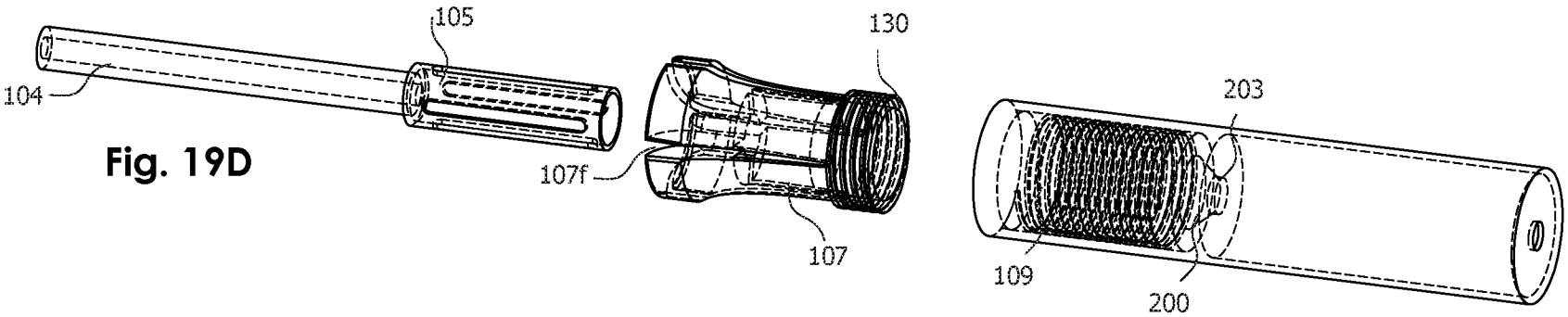
FIG. 19D is an exploded view of an embodiment of the present invention.
Figure 19E:
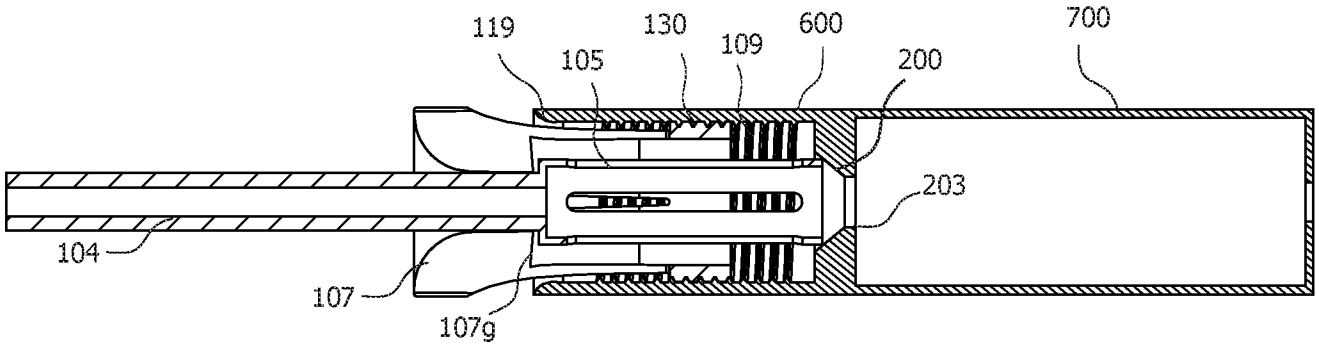
FIG. 19E is a sectional elevation view of an embodiment of the present invention highlighting the internal mechanisms of the adapter.
Figure 19F:
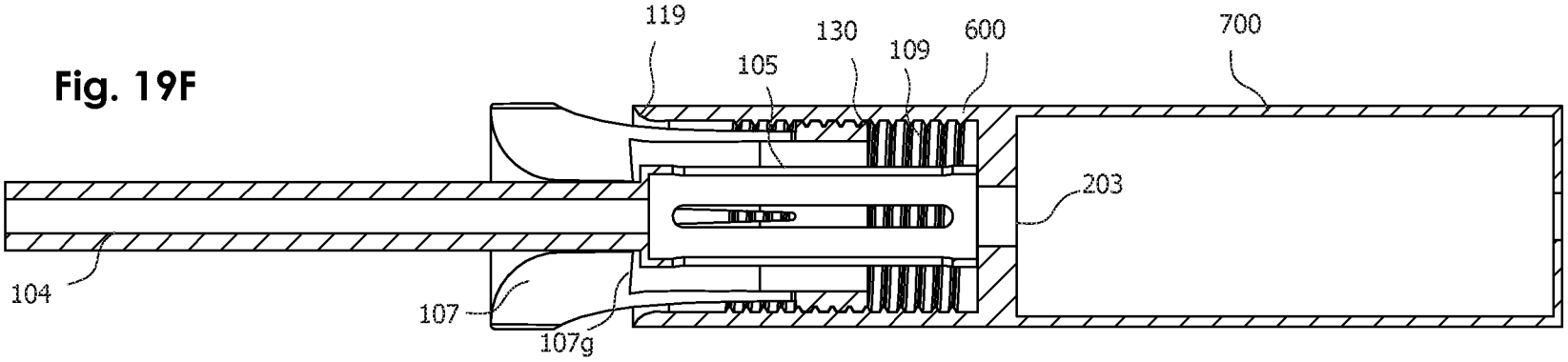
FIG. 19F is a sectional elevation view of an embodiment of the present invention.
Figure 20A:
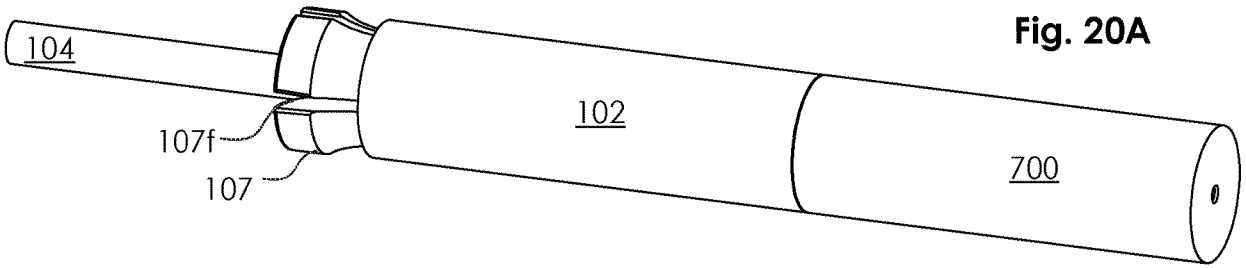
FIG. 20A is a perspective view of an embodiment of the present invention.
Figure 20B:
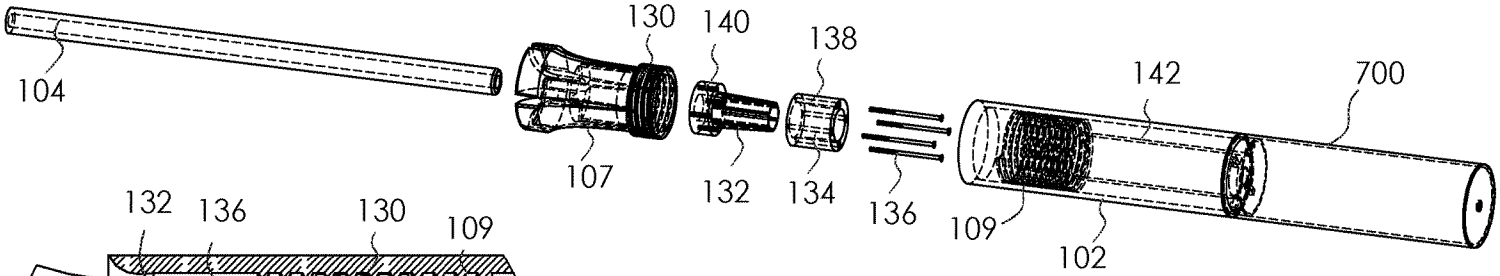
FIG. 20B is an exploded view of an embodiment of the present invention.
Figure 20C:
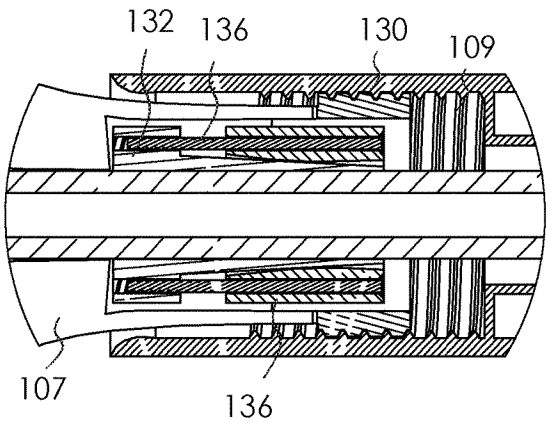
FIG. 20C is a close up sectional elevation view of section A shown in FIG. 20D.
Figure 20D:
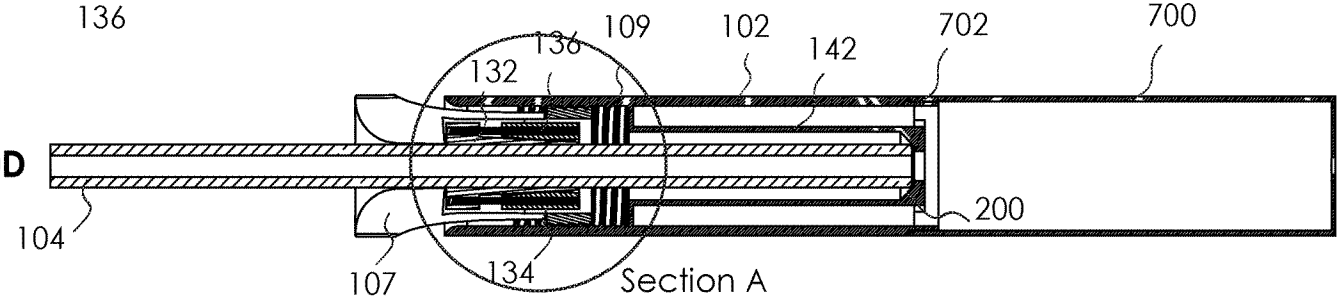
FIG. 20D is a sectional elevation view of an embodiment of the present invention.

As depicted in FIGS. 19D-19E, constricting sleeve 107 can engage flash hider 105, or any other structural attachment to the firearm barrel, instead of anchor 113. Inwardly extending catchment flange 107*g* catches the proximal end of flash hider 105 when constricting sleeve 107 is tightened around barrel 104. This engagement likewise prevents the adapter from translating in a distal direction when the firearm is discharged.

Referring now to FIG. 20, an embodiment of the anchor may be comprised of constricting body 132 and compression ring 134. Constricting body 132 has a similar design as constricting sleeve 107, with a discontinuous distal end and a tapered outer surface. Compression ring 134 has a consistent inner diameter or an internal surface inversely tapered with respect to constricting body 132. Compression ring 134, when forced onto the distal end of constricting sleeve 132 and towards the proximal end of constricting sleeve 132, comes into contact with the tapered outer surface of constricting sleeve 132 causing it to constrict in diameter and become fixedly secured to a firearm barrel 104. Fasteners 136 pass through apertures 138 in compression ring 134 and engage threaded apertures 140 in constricting body 132. When tightened, fasteners 136 force compression ring 134 towards the proximal end of constricting sleeve 132 to further reduce the internal diameter of constricting body 132 and fixedly secure the anchor to firearm barrel 104. In an embodiment, the fasteners pass through apertures in the constricting body and engage threaded apertures in the compression ring.

The embodiment in FIG. 20 also depict a muzzle device such as a suppressor being attachable to sheath 102 through threads. The muzzle device may, however, be integrated with sheath 102 or attachable to sheath 102 via any other fasteners know to a person of ordinary skill in the art.

FIG. 20 also depict an embodiment having extension chamber 142 disposed within sheath 102, however, other some embodiments may not include extension chamber 142. Extension chamber 142 increases the volume in which expelled gases can be discharged and thus makes a suppressor more effective. As depicted, extension chamber extends generally from threads 109 to the distal end of sheath 102. The distal end of extension chamber 142 also includes barrel alignment guide 200, but an embodiment may simply include a muzzle stop.

Referring now to FIG. 21, the adapter may include gas containment sleeve 150 and/or a constricting sleeve release mechanism 144. The embodiment shown in FIG. 21 also includes a more generic suppressor mount 702 adapted to engage suppressor 700 via threads or any other fastening device known to a person of ordinary skill in the art. Suppressor mount 702 may be sized and threaded to engage any known suppressors/muzzle devices. The depicted embodiment as best shown in FIG. 21D, also includes the barrel alignment guide having a stepwise taper rather than a smoothly sloped taper. Each of these features may be used in combination with other embodiments disclosed herein.

Figure 21A:
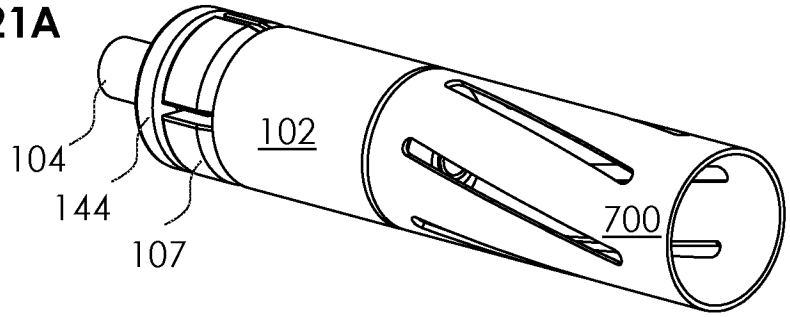
FIG. 21A is a perspective view of an embodiment of the present invention.
Figure 21B:
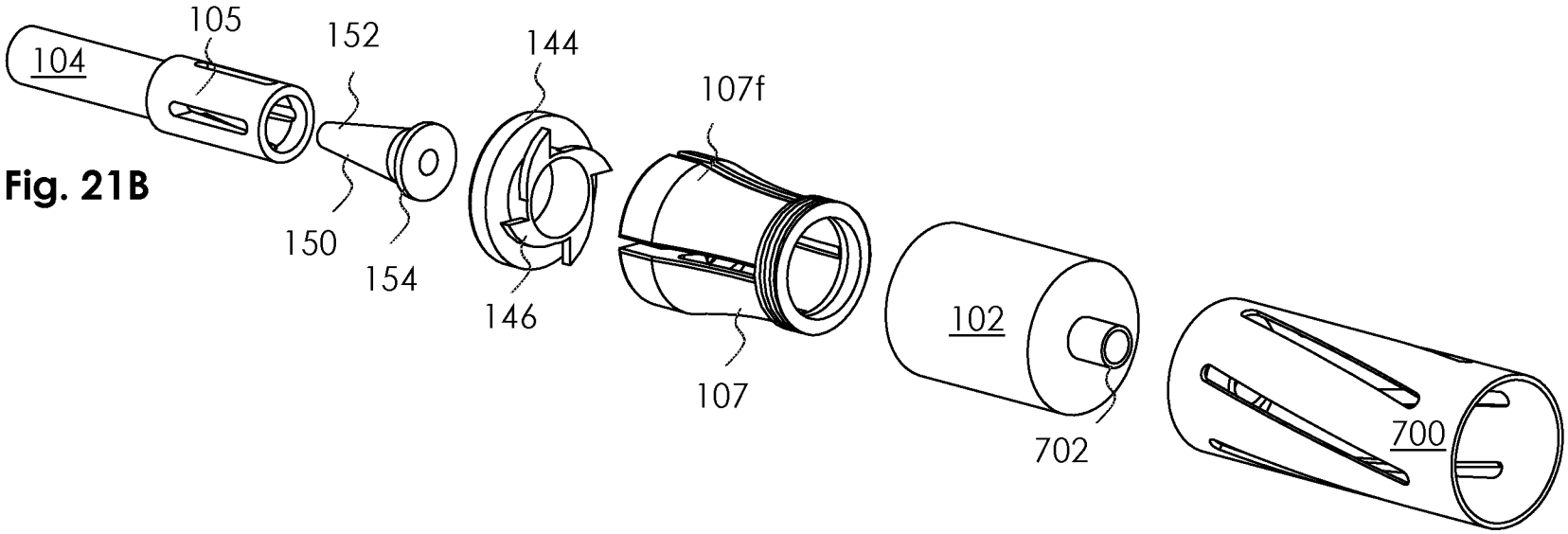
FIG. 21B is an exploded view of an embodiment of the present invention.
Figure 21C:
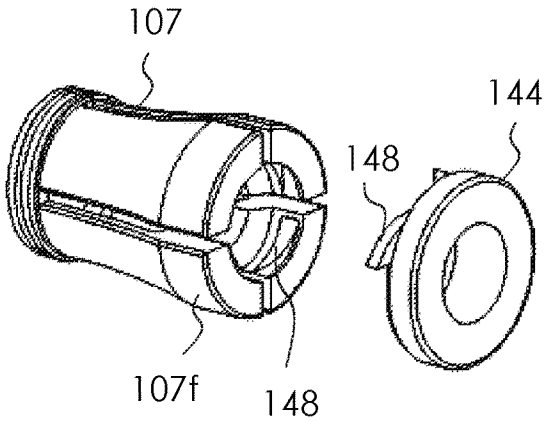
FIG. 21C is a sectional view of an embodiment of the constricting sleeve and an embodiment of the release mechanism.
Figure 21D:
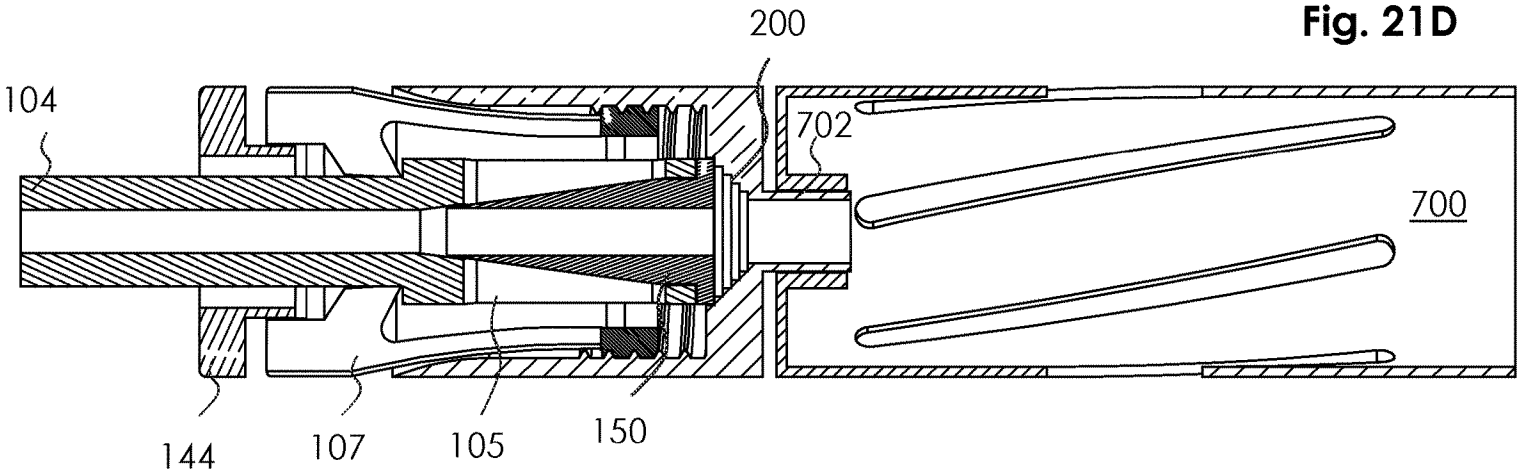
FIG. 21D is a sectional elevation view of an embodiment of the present invention highlighting the internal mechanisms of the adapter.

Release mechanism 144 includes a central bore 146 to receive barrel 104 and a plurality of arcuate shaped teeth 148. Teeth 148 are intended to rest within their correspondingly shaped receipts 147 disposed within the proximal end of constricting sleeve 107 which are depicted best in FIG. 21C. When in a position of repose as depicted in FIG. 21D, release mechanism 144 has no effect on constricting sleeve 107. However, when rotated in one direction (clockwise if viewed from a proximal position in FIG. 21B), the arcuate shapes of teeth 148 begin to rotate out of their respective receipts 148 causing the inner diameter of constricting sleeve 107 to increase as arms 107*f* are forced away from the longitudinal axis of constricting sleeve 107. When arms 107*f* are forced away from the longitudinal axis of constricting sleeve 107, so are the catchment flanges 107*g* and after some degree of rotation, catchment flanges 107*g* are moved out of contact with flash hider 105 or barrel anchor 107. At that point, constricting sleeve 107 can be removed from firearm barrel 104.

FIG. 22 provide another embodiment of the release mechanism, generally denoted by reference numeral 143. Release mechanism 143 separate arms 107*f* when it is translated in a direction that is parallel to the longitudinal axis of the constricting sleeve. In the embodiment depicted, release mechanism 143 includes engagement ring 145 that resides within the discontinuous slot 147 in constricting sleeve 107. In its position of repose (at its distal most position as allowed by slot 147) as depicted in FIG. 22D, release mechanism 143 does not affect constricting sleeve 107. However, if release mechanism 143 is pulled proximally, the slope of slot 147 and the fixed diameter of engagement ring 145 forces arms 107*f* outwards causing the inner diameter of constricting sleeve 107 to increase.

While two different release mechanisms are depicted in FIGS. 21 and 22, it is considered that the release mechanism and corresponding engagement of the constricting sleeve may have many different shapes and connections such that manipulation of the release mechanism causes arms 107*f* to open outwardly.

Referring back to FIG. 21, gas containment sleeve 150 is designed to prevent expelled gases from exiting the slots in flash hider 105. Outer surface 152 is tapered to match the inner tapered surface of flash hider 105. Gas containment sleeve 105, however, may have a non-tapered outer surface as shown in FIG. 22 and may also have an inner diameter greater than the outer diameter of flash hider 105 to ensleeve flash hider 105 as depicted in FIG. 23. As depicted in FIG. 21D, this embodiment of gas containment sleeve 150 is preferably sized to extend into barrel 104 to ensure that all of the expelled gases are redirected out of the gas containment sleeve and into the attached muzzled device 700. An embodiment of gas containment sleeve 150 may also include muzzle stop 154 that abuts the muzzle end of flash hider 105.

As depicted in FIG. 22, an embodiment of gas containment sleeve 150 is designed to threadedly engage an annular extending support section of sheath 102. In the depicted embodiment, said support section is also barrel alignment guide 200 having a proximally tapered outer surface. The inner surface of barrel alignment guide 200 includes threads 209 to engage threads 156 on gas containment sleeve 150. The distal end of gas containment sleeve 150 includes tool notch 158 adapted to receive a flat head screwdriver or similar tool to adjust the threaded engagement. The threads allow the depth of gas containment sleeve to be adjusted for different flash hiders 105. To engage slot 158, muzzle device 700 or sheath 102 includes a detachable end cap 160. End cap 160 is attachable to muzzle device 700 or sheath 102 via threads or any other fastening device known to a person of ordinary skill in the art.

Figure 22A:
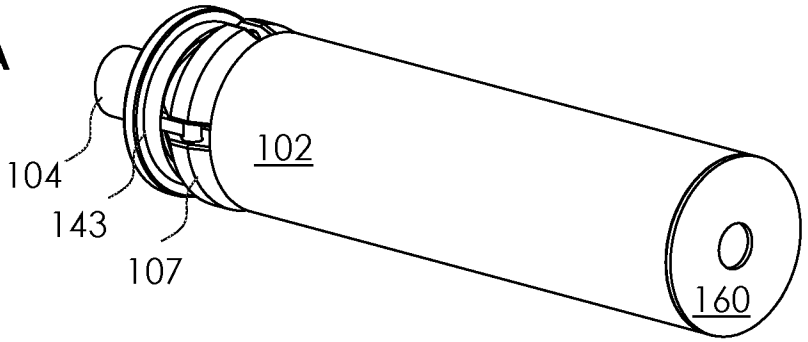
FIG. 22A is a perspective view of an embodiment of the present invention.
Figure 22B:
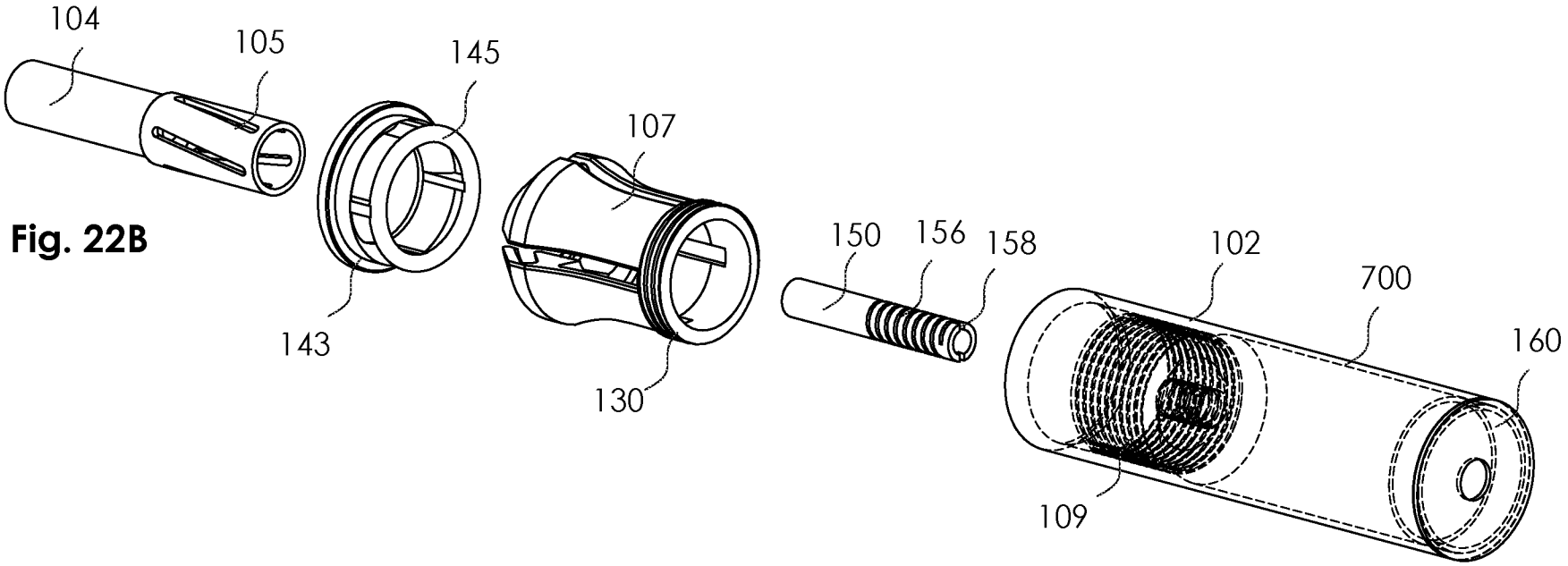
FIG. 22B is an exploded view of an embodiment of the present invention.
Figure 22C:
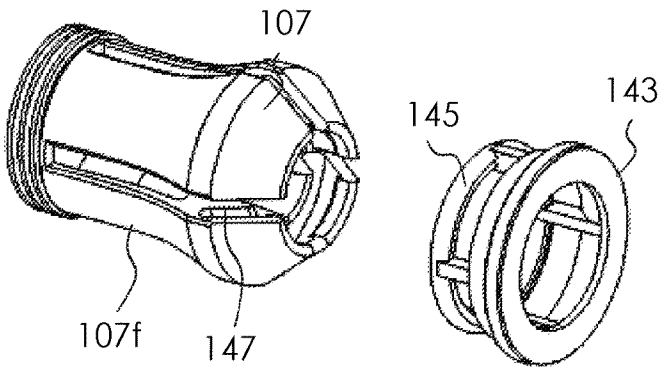
FIG. 22C is a sectional view of an embodiment of the constricting sleeve and an embodiment of the release mechanism.
Figure 22D:
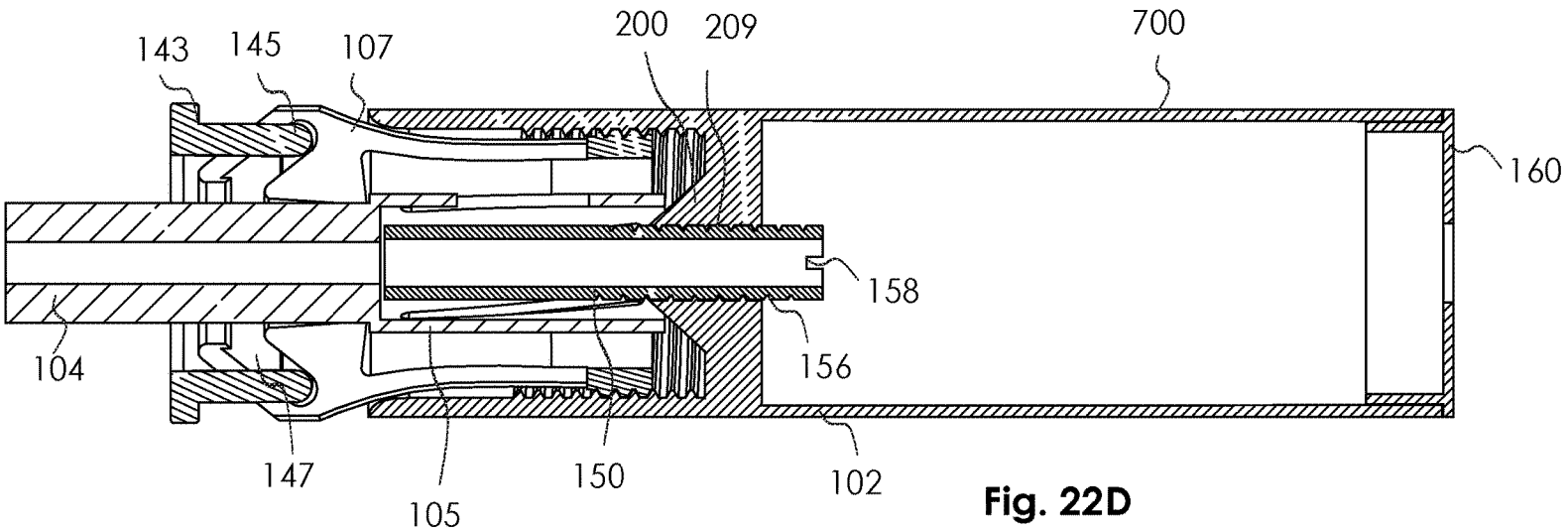
FIG. 22D is a sectional elevation view of an embodiment of the present invention highlighting the internal mechanisms of the adapter.
Figure 23A:
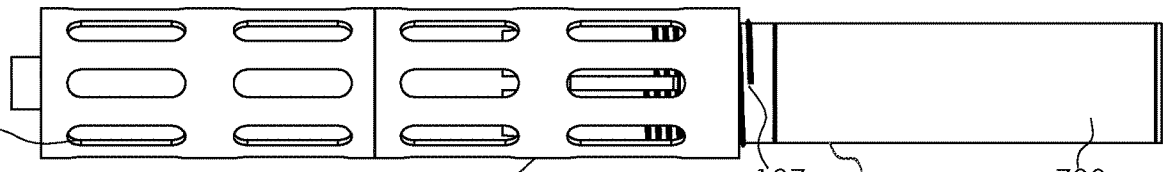
FIG. 23A is a perspective view of an embodiment of the present invention.
Figure 23B:
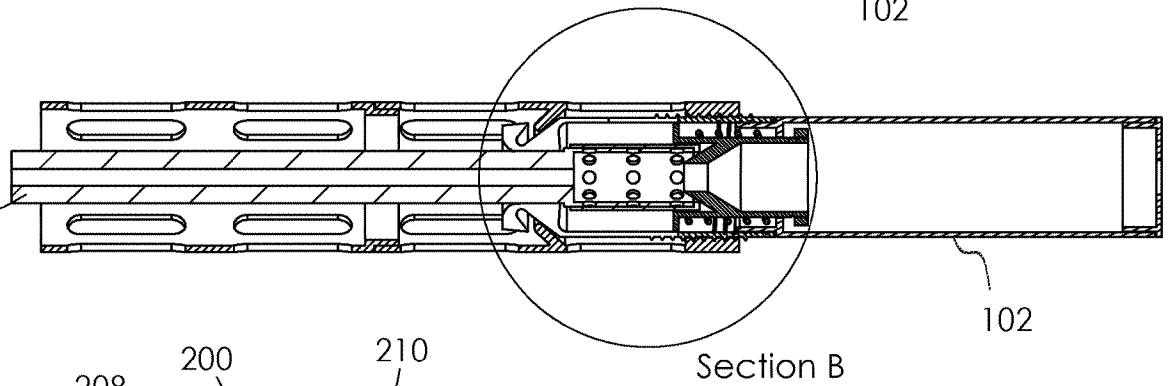
FIG. 23B is a sectional elevation view of an embodiment of the present invention.
Figure 23C:
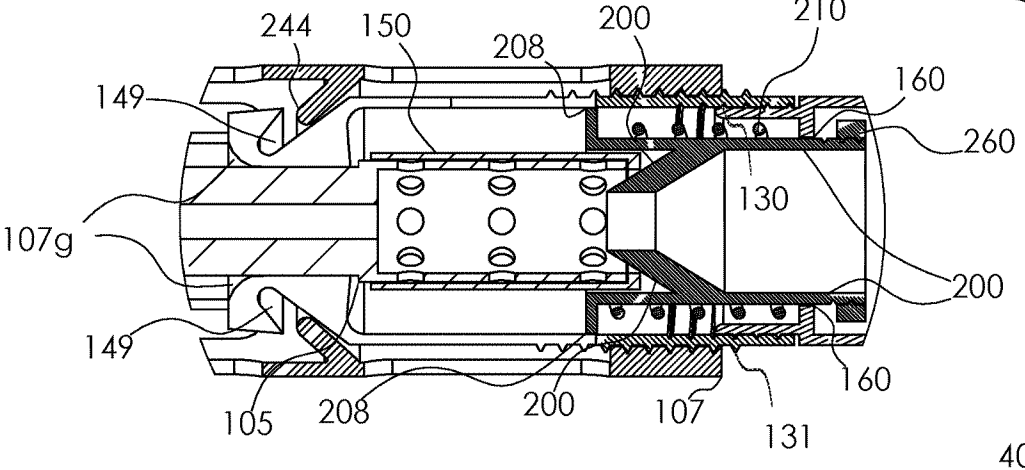
FIG. 23C is a close up sectional elevation view of section B shown in FIG. 23B.
Figure 23D:
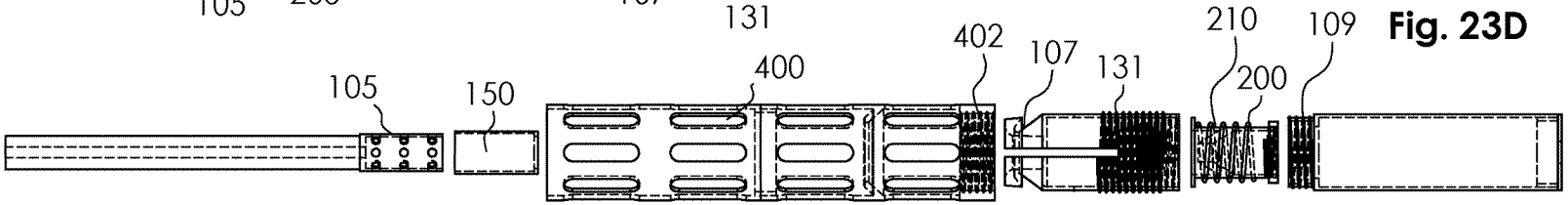
FIG. 23D is an exploded view of an embodiment of the present invention.

While barrel alignment guide 200 is shown as having a tapered outer surface sized to receive the distal ends of either barrel 104 or flash hider 105, other embodiments of barrel guide 200 have a tapered inner surface where the taper is directed in the opposite direction of that shown in FIG. 22D. Moreover, barrel guide 200 may be spring loaded as depicted in FIG. 23. As shown, spring 210 resides between spring stop 208 and annular projection 160 extending inwardly from sheath 102. Barrel guide 200 is adapted to slidably translate within sheath 102 and/or constricting sleeve 107 to engage the muzzle end of flash hider 105 or barrel 104. The tapered shape of barrel guide 200 brings the muzzle end of flash hider 105 or barrel 104 into axial alignment with the aperture 203 and in turn sheath 102.

FIG. 23 also depict a variation of constricting sleeve 107 designed to engage a firearm rail. As shown, constricting sleeve 107 includes an outwardly extending radial flange 107*g* that includes rail engagement slot 149. As shown, rail 400 includes an angled flange 402 sized to receive rail engagement slot 149. Angled flange 402 is preferably flexible to allow the proximal end of constricting sleeve 107 to force flange 402 outwardly as constricting sleeve 107 is slid into position.

The embodiment shown in FIG. 23 includes suppressor 700 directly integrated into sheath 102. As a single unit, threads 109 of sheath 102 threadedly engage threads 130 on constricting sleeve 107. As depicted, threads 109 are external and threads 130 are internal, but the location of the threads may be inverted such that threads 109 are internal and threads 130 are external. In addition, sheath 102 may connect to constricting sleeve 107 via any fastening methods known to a person of ordinary skill in the art. Rail 400 may also include threads 402 designed to engage external threads 131 on constricting sleeve 107.

The various embodiments depicted in the exemplary images illustrate a multitude of embodiments for each component described herein. It is considered that the various embodiments of the different components can be used interchangeably for the various adaptors.

Glossary of Claim Terms

Sheath: is an elongated tubular structure.

Sleeve: is a structural member having an inner lumen.

Tubular: means having the form or shape of a hollow, elongated body.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An adapter for a firearm, comprising:

a sheath, the sheath including:

a first end, a second end, and a tubular body extending therebetween and establishing an inner surface;

the second end being integrated with a muzzle device or attachable to the muzzle device;

a constricting sleeve, the constricting sleeve including:

a first end, a second end, and a tubular body extending therebetween and establishing an inner surface;

at least a portion of the first end having a discontinuous perimeter thereby enabling the inner surface to adjust in diameter;

the inner surface having a diameter that is greater than a diameter of a firearm barrel when the constricting sleeve receives the firearm barrel;

a catchment flange formed with or joined to the constricting sleeve, the catchment flange extending inwardly to catch a proximal end of an anchor or a barrel device extending outward from the firearm barrel, wherein the catchment flange catches the anchor or the barrel device by moving radially inward when the diameter of the inner surface of the constricting sleeve is adjusted;

the inner surface of the sheath at the first end thereof having a diameter sized to receive at least a portion of the constricting sleeve; and at least one of an outer surface of the first end of the constricting sleeve and the inner surface of the first end of the sheath being tapered inwardly towards the second end of the sheath.

2. The adapter of claim 1, wherein the barrel device is a flash hider.

3. The adapter of claim 1, further including:

a barrel guide in communication with the sheath or muzzle device, the barrel guide having:

a tapered aperture concentrically aligned with the constricting sleeve, thereby providing a passage for a bullet leaving the firearm barrel;

the tapered aperture having a greater diameter at a proximal end than at a distal end; and whereby an axial force causing the firearm barrel to contact the tapered aperture of the barrel guide will funnel the firearm barrel into axial alignment with the aperture.

4. The adapter of claim 3, further including a spring disposed between a spring platform on the barrel guide and a spring base on the sheath or muzzle device, the spring forcing the barrel guide in a proximal direction.

5. The adapter of claim 1, further including a gas containment sleeve that fits into or around a flash hider to direct expelled gases into the muzzle device.

6. The adapter of claim 5, wherein the gas containment sleeve includes threads to engage a threaded portion of the sheath or muzzle device.

7. The adapter of claim 5, further including a spring disposed between a spring platform on the gas containment sleeve and a spring base on the sheath or muzzle device, the spring forcing the gas containment sleeve in a proximal direction.

8. The adapter of claim 1, further including a flexible fitment sleeve having an incomplete tubular shape establishing an adjustable diameter.

9. The adapter of claim 1, further including the second end of the constricting sleeve having a plurality of threads adapted to engage a plurality of threads disposed on the sheath.

10. The adapter of claim 1, further including a release mechanism adapted to engage the first end of the constricting sleeve, wherein manipulation of the release mechanism causes the second end of the constricting sleeve to increase in diameter.

11. The adapter of claim 1, wherein the constricting sleeve further includes an outwardly extending catchment flange adapted to catch a portion of a firearm rail.

12. The adapter of claim 1, wherein the muzzle device is a firearm suppressor.

13. An adapter for a firearm, comprising:

a sheath, the sheath including:

a first end, a second end, and a tubular body extending therebetween and establishing an inner surface;

the second end being integrated with a muzzle device or attachable to the muzzle device;

a constricting sleeve, the constricting sleeve including:

a first end, a second end, and a tubular body extending therebetween and establishing an inner surface;

at least a portion of the first end and at least a portion of the second end having a discontinuous perimeter thereby enabling the inner surface to adjust in diameter;

the inner surface having a diameter that is greater than a diameter of a firearm barrel when the constricting sleeve receives the firearm barrel;

an inwardly extending catchment flange formed with or joined to the constricting sleeve, the catchment flange adapted to catch a proximal end of an anchor or a barrel device extending outwardly from the firearm barrel by moving radially inward when the diameter of the inner surface of the constricting sleeve is adjusted;

the inner surface of the sheath at the first end thereof having a diameter sized to receive at least a portion of the constricting sleeve; and at least one of an outer surface of the first end of the constricting sleeve and the inner surface of the first end of the sheath being tapered inwardly towards the second end of the sheath.

14. The adapter of claim 13, wherein the barrel device is a flash hider.

15. The adapter of claim 13, further including:

a barrel guide in communication with the sheath or muzzle device, the barrel guide having:

a tapered aperture concentrically aligned with the constricting sleeve, thereby providing a passage for a bullet leaving the firearm barrel;

the tapered aperture having a greater diameter at a proximal end than at a distal end; and whereby an axial force causing the firearm barrel to contact the tapered aperture of the barrel guide will funnel the firearm barrel into axial alignment with the aperture.

16. The adapter of claim 15, further including a spring disposed between a spring platform on the barrel guide and a spring base on the sheath or muzzle device, the spring forcing the barrel guide in a proximal direction.

17. The adapter of claim 13, further including a gas containment sleeve that fits into or around a flash hider to direct expelled gases into the muzzle device.

* * * * *